US012376680B2

(12) United States Patent
Lawrence

(10) Patent No.: US 12,376,680 B2
(45) Date of Patent: Aug. 5, 2025

(54) FOLDABLE CHAIR

(71) Applicant: Dorel Home Furnishings, Inc., Wright City, MO (US)

(72) Inventor: Kyle J. Lawrence, Greenfield, IN (US)

(73) Assignee: Dorel Home Furnishings, Inc., Wright City, MO (US)

( * ) Notice: Subject to any disclaimer, the term of this patent is extended or adjusted under 35 U.S.C. 154(b) by 161 days.

(21) Appl. No.: 18/196,172

(22) Filed: May 11, 2023

(65) Prior Publication Data

US 2023/0363539 A1 Nov. 16, 2023

Related U.S. Application Data

(60) Provisional application No. 63/340,576, filed on May 11, 2022.

(51) Int. Cl.
*A47C 7/00* (2006.01)
*A47C 4/10* (2006.01)

(52) U.S. Cl.
CPC ..... *A47C 4/10* (2013.01)

(58) Field of Classification Search
CPC ..... A47C 4/00; A47C 4/04; A47C 4/24
See application file for complete search history.

(56) References Cited

U.S. PATENT DOCUMENTS 467,340 A 1/1892 Chichester
2,110,519 A 5/1936 Croft
2,381,574 A 5/1943 Clarin
4,298,227 A 11/1981 Berthier et al.
7,219,955 B2 * 5/2007 Lu ..... A47C 4/20 297/58
7,753,439 B2 * 7/2010 Akkad ..... A47C 4/10 297/23
8,029,059 B2 * 10/2011 Smith ..... A47C 4/38 248/188.8
8,033,598 B2 * 10/2011 Smith ..... A47C 5/06 297/440.11
8,033,612 B2 * 10/2011 Smith ..... A47C 3/04 297/440.11
8,038,221 B2 * 10/2011 Smith ..... A47C 5/06 297/440.11
8,317,269 B2 * 11/2012 Smith ..... A47C 7/54 297/440.11
8,322,787 B2 * 12/2012 Smith ..... A47C 3/04 403/396
8,454,093 B2 * 6/2013 Smith ..... A47C 4/48 297/452.21
9,492,014 B1 * 11/2016 Smith ..... A47C 4/28
(Continued)

OTHER PUBLICATIONS

International Search Report and Written Opinion for Application No. PCT/US2023/021870, dated Jul. 5, 2023, 10 pages.

*Primary Examiner* — Shin H Kim
(74) *Attorney, Agent, or Firm* — Barnes & Thornburg

(57) ABSTRACT

A foldable chair includes a front-leg unit, a seat bottom mounted on the front-leg unit for pivotable movement relative to the front-leg unit, a rear-leg unit mounted on the front-leg unit for pivotable movement relative to the front-leg unit, and mover means for driving the rear-leg unit away from the front-leg unit to establish an expanded-use mode of the foldable char and for driving the rear-leg unit towards the front-leg unit to establish a collapsed-storage mode of the foldable chair.

17 Claims, 17 Drawing Sheets

(56) References Cited

U.S. PATENT DOCUMENTS

| | | | | |
|---|---|---|---|---|
| 10,806,264 | B1 * | 10/2020 | Chen | A47C 7/029 |
| 2001/0033100 | A1 * | 10/2001 | Haney | A47C 4/20 297/55 |
| 2003/0234563 | A1 * | 12/2003 | Huang | A47C 7/002 297/58 |
| 2009/0146467 | A1 * | 6/2009 | Waite | A47C 4/20 297/440.2 |
| 2020/0001156 | A1 * | 1/2020 | Hughes | A47C 15/004 |

* cited by examiner

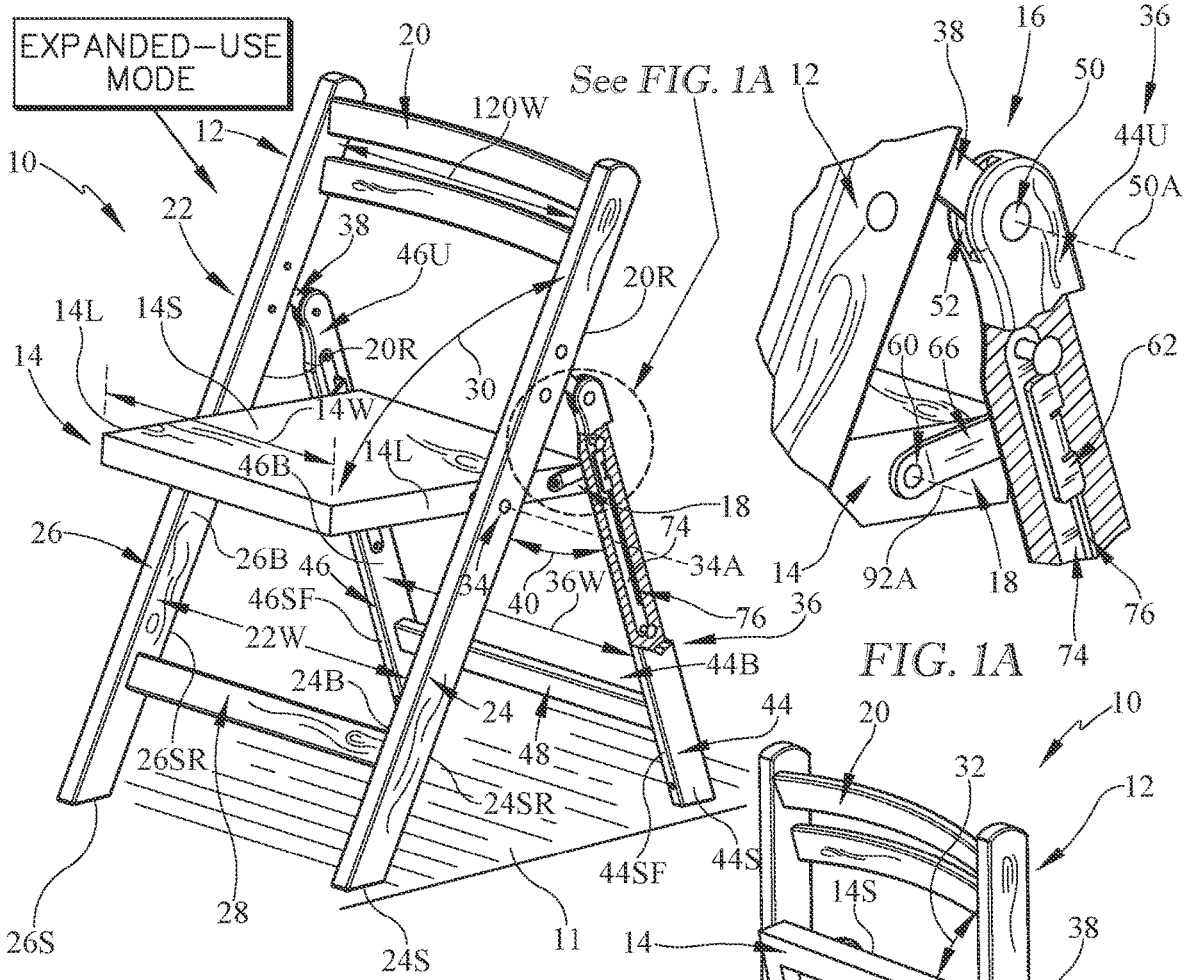
FIG. 1
FIG. 1A
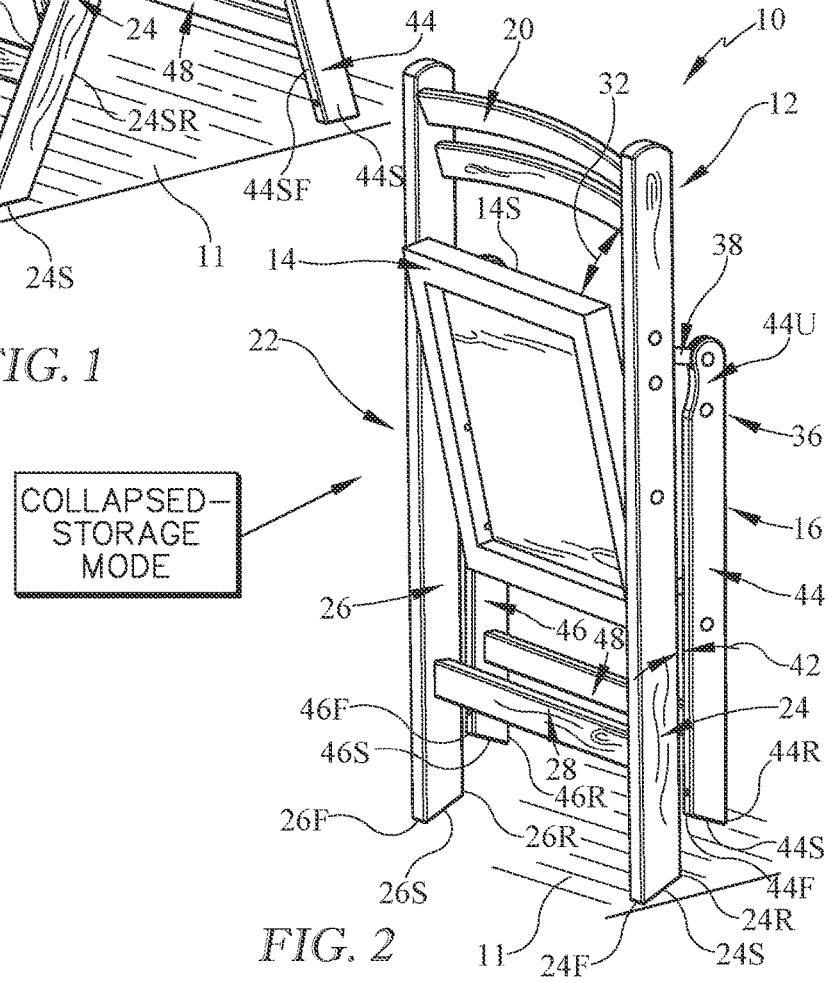
FIG. 2

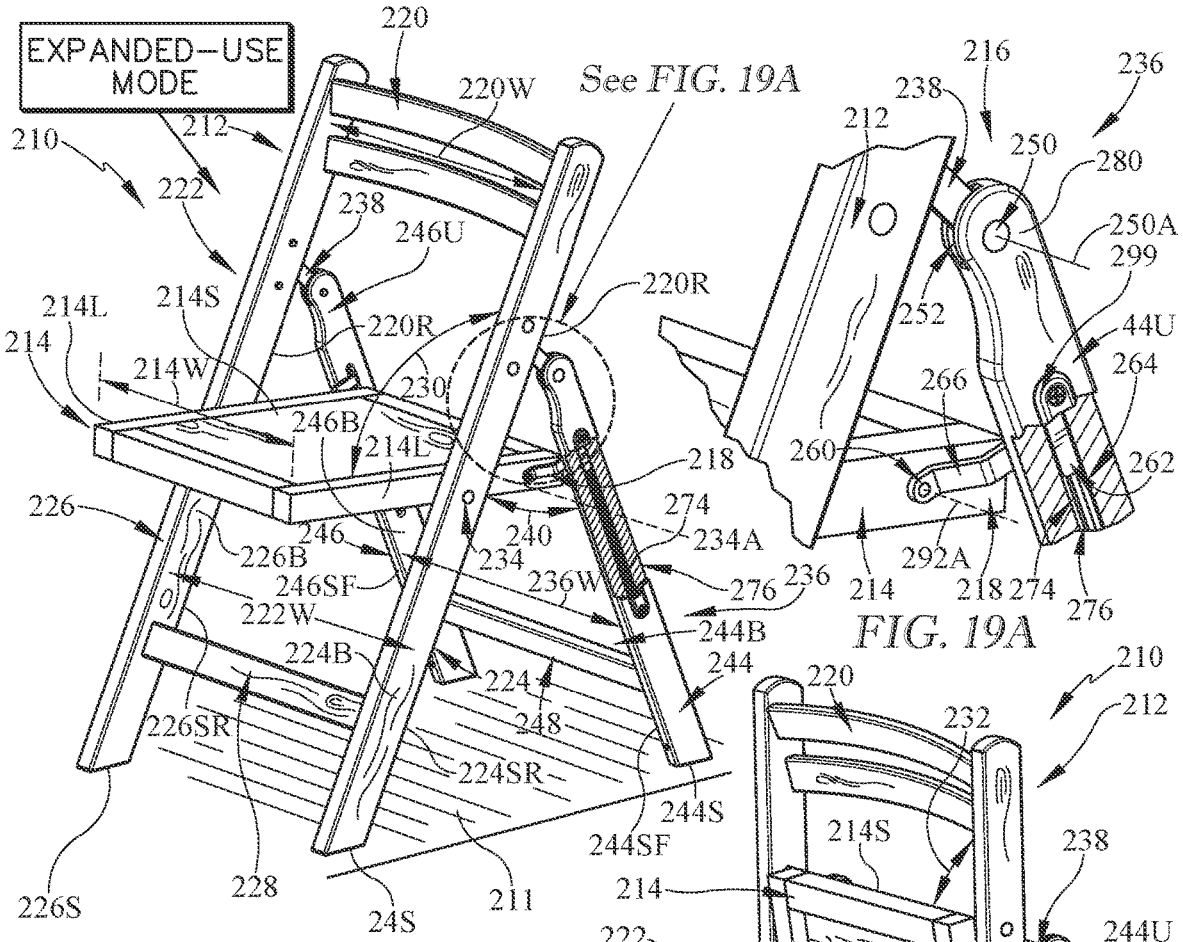
FIG. 19
FIG. 19A
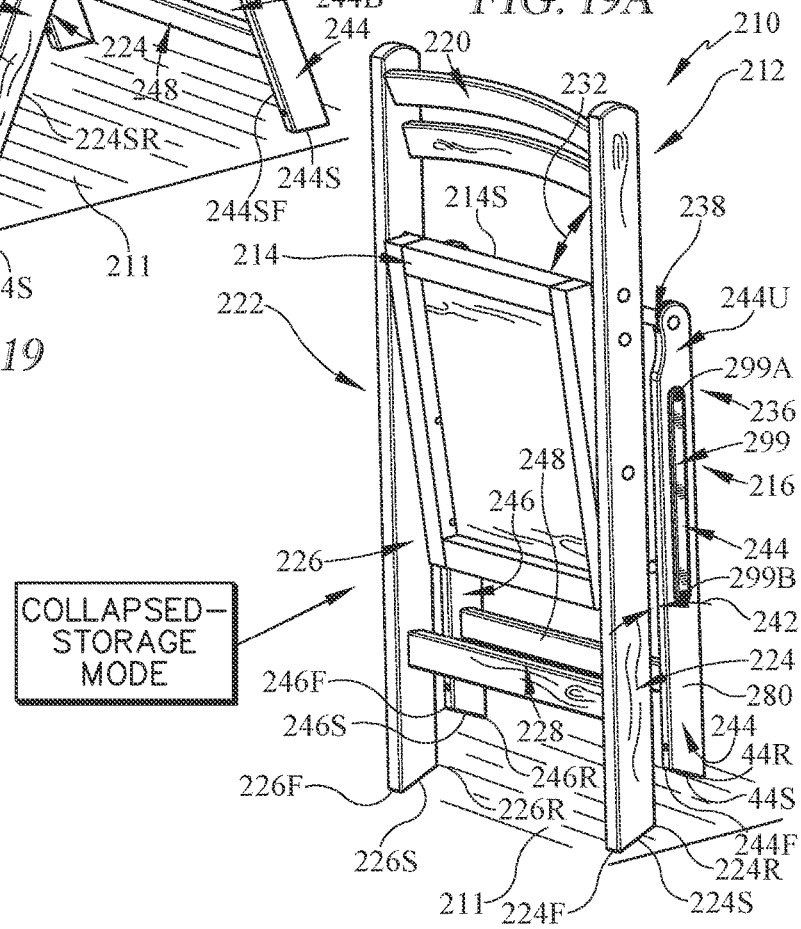
FIG. 20

FOLDABLE CHAIR

CROSS-REFERENCE TO RELATED APPLICATIONS

This application claims the benefit and priority under 35 U.S.C. § 119(e) to U.S. Provisional Application No. 63/340,576, filed May 11, 2022, the disclosure of which is expressly incorporated herein by reference in its entirety.

BACKGROUND

The present disclosure relates to furniture, and in particular, to folding furniture. More particularly, the present disclosure relates to a folding chair.

SUMMARY

According to the present disclosure, a foldable chair includes a front-leg unit, a seat bottom, and a rear-leg unit. The front-leg unit includes a seat back and a front leg coupled to the seat back to move therewith during folding and unfolding of the foldable chair. The seat bottom is mounted on the front-leg unit for pivotable movement relative to the seat back from a horizontal-support position in which a support surface of the seat bottom is separated from the seat back by a support angle to a vertical-stowed position in which the support surface of the seat bottom is separated from the seat back by a stowed angle such that the stowed angle is less than the support angle.

In illustrative embodiments, the rear-leg unit is in spaced apart relation to the front-leg unit so that an upper gap is formed between the seat back and the rear-leg unit and a lower gap is formed between the front leg and the rear-leg unit, The rear-leg unit is further mounted on the front-leg unit for pivotable movement relative to the front-leg unit during folding and unfolding of the foldable chair from an extended position in which the rear-leg unit cooperates with the front leg to define an extended angle to a retracted positon in which the rear-leg unit cooperates with the front leg to define a retracted angle such that the retracted angle is less than the extended angle.

In illustrative embodiments, the foldable chair further includes mover means for driving the rear-leg unit away from the front-leg unit from the retracted position to the extended position in response to pivoting movement of the seat bottom away from the seat back from the vertical-stowed position to the horizontal-support position to establish an expanded-use mode of the foldable chair. In the expanded-use mode the seat bottom is supported in a substantially horizontal orientation to support an occupant. In illustrative embodiments, the move means is also for driving the rear-leg unit toward the front-leg unit from the extended position to the retracted position in response to pivoting movement of the seat bottom toward the seat back from the horizontal-support portion to the vertical-stowed position to establish a collapsed-storage mode of the foldable chair. In the collapsed-storage mode, the seat bottom is supported in a substantially vertical orientation. The upper gap between the rear-leg unit and the seat back is maintained in both the expanded-use mode and the collapsed-storage mode.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIG. 1 is a perspective view of a foldable chair broken away to show that the foldable chair includes a front-leg unit having a seat back and a front leg coupled to the seat back, a seat bottom mounted on the front-leg unit, a rear-leg unit mounted on the seat back for pivotable movement relative to the front-leg unit during folding and unfolding of the foldable chair, and a rear-leg driver that drives the rear-leg unit away from the front-leg unit in response to pivoting movement of the seat bottom to establish an expanded-use mode of the foldable chair in which the seat bottom is supported in a substantially horizontal orientation to seat an occupant;

FIG. 1A is detailed view of the foldable chair of FIG. 1 broken away to show that the rear-leg driver includes a pivot mount that is coupled to a rear portion of the seat bottom, a slider that is adapted to be placed in a slide passageway formed in the rear-leg unit, and a connecting rod interconnecting the pivot mount and the slider;

FIG. 2 is a perspective view of the foldable chair of FIG. 1 showing that the rear-leg driver drives the rear-leg unit toward the front-leg unit in response to pivoting movement of the seat bottom to establish a collapsed-storage mode of the foldable chair in which the seat bottom is supported in a substantially vertical orientation;

Figure 3:
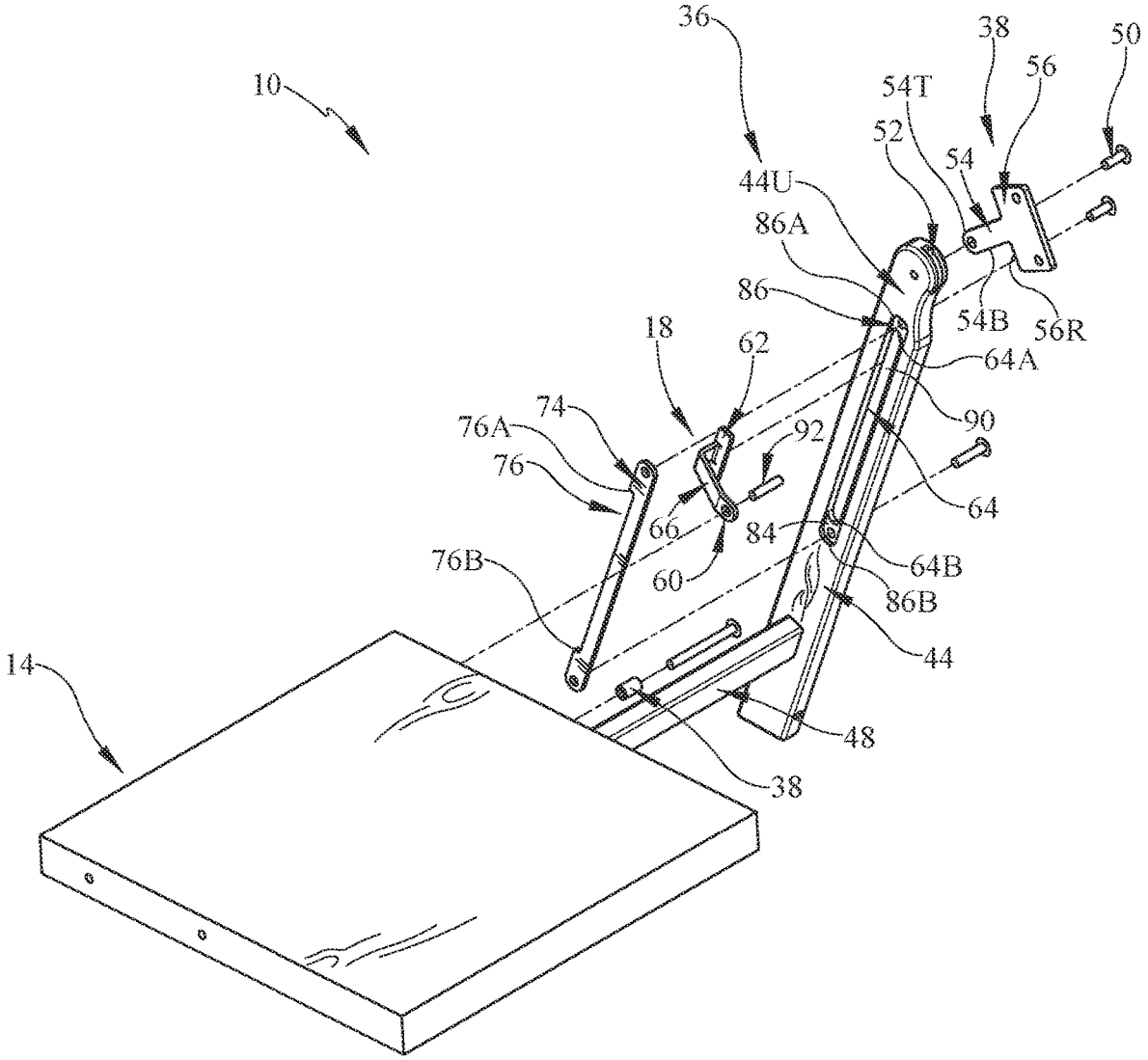
Figure 4A:
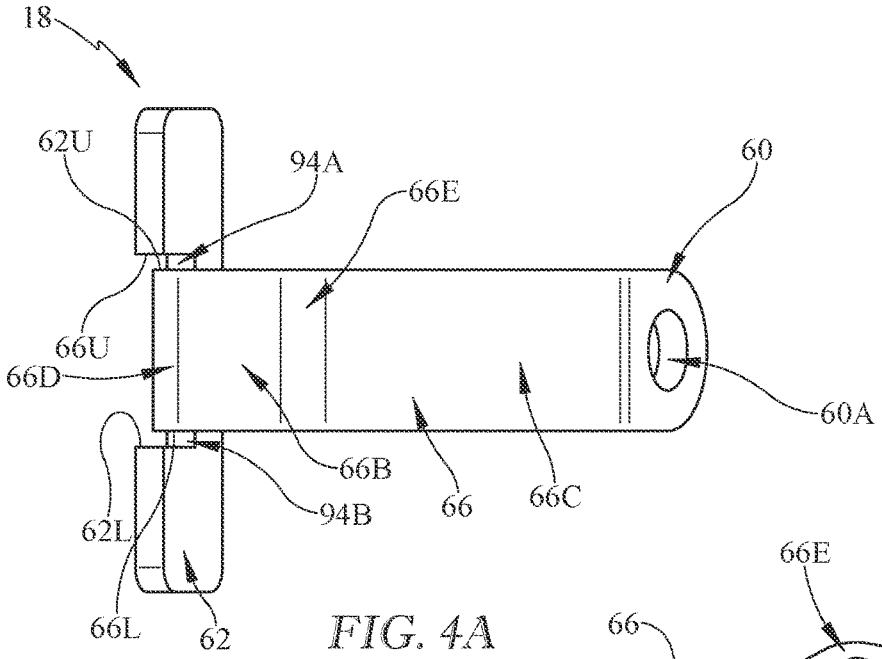
Figure 4B:
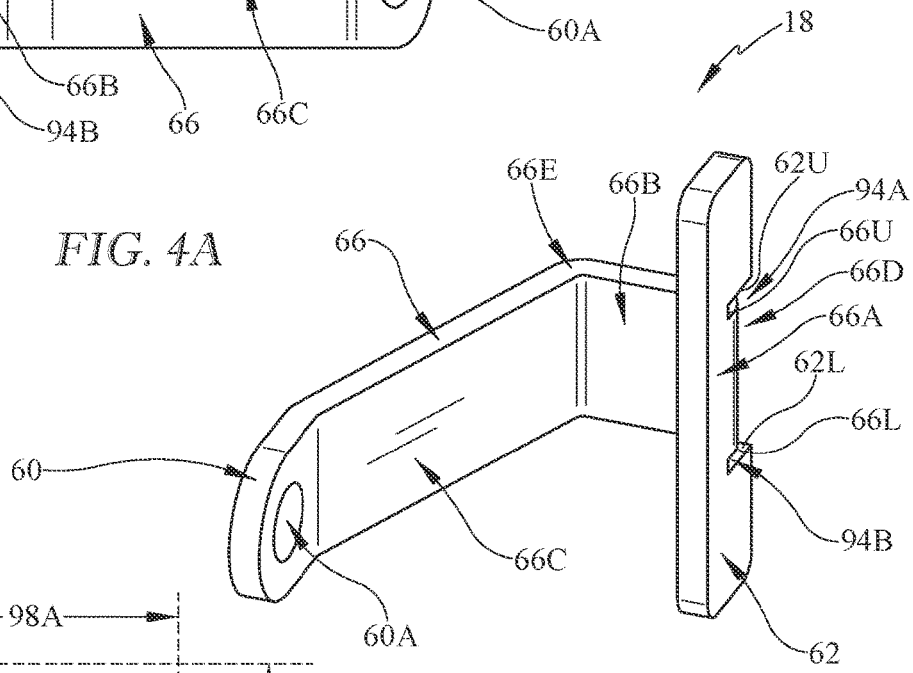
Figure 4C:
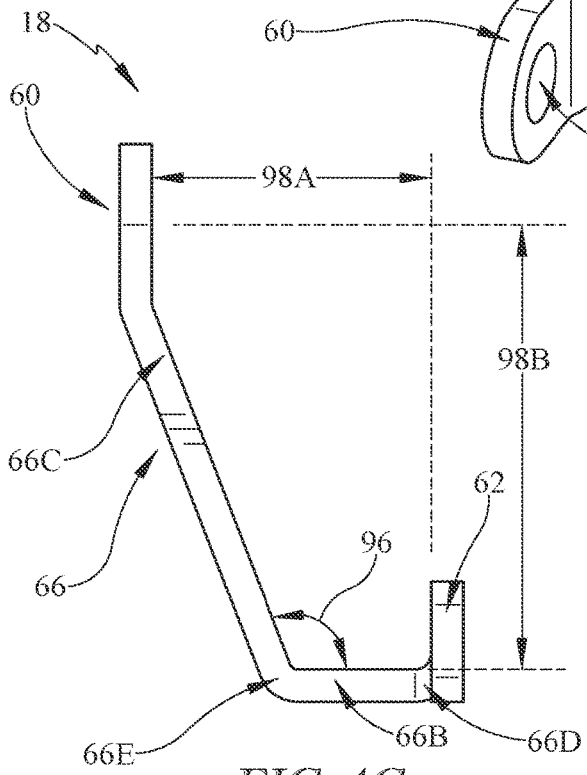
Figure 5:
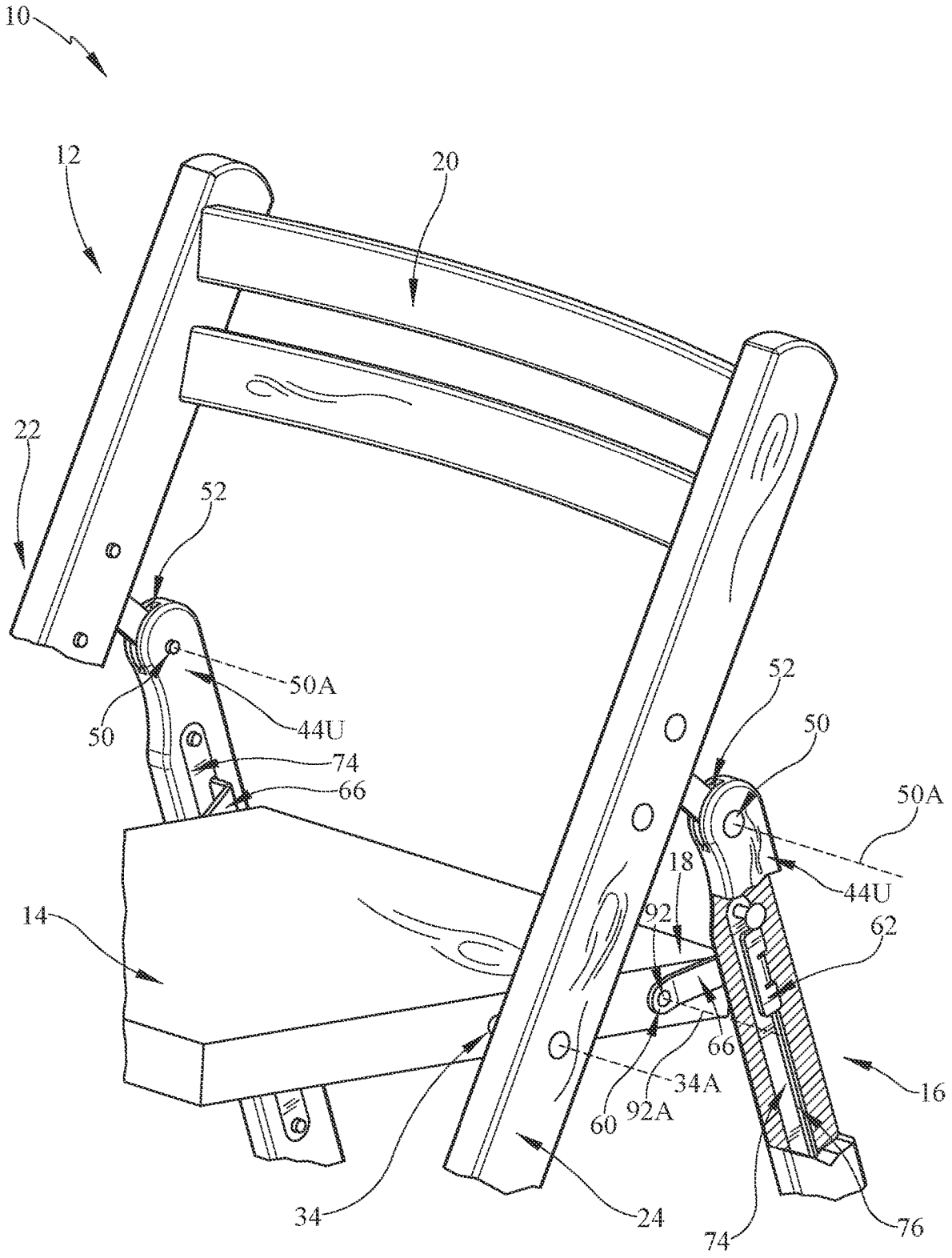
Figure 6:
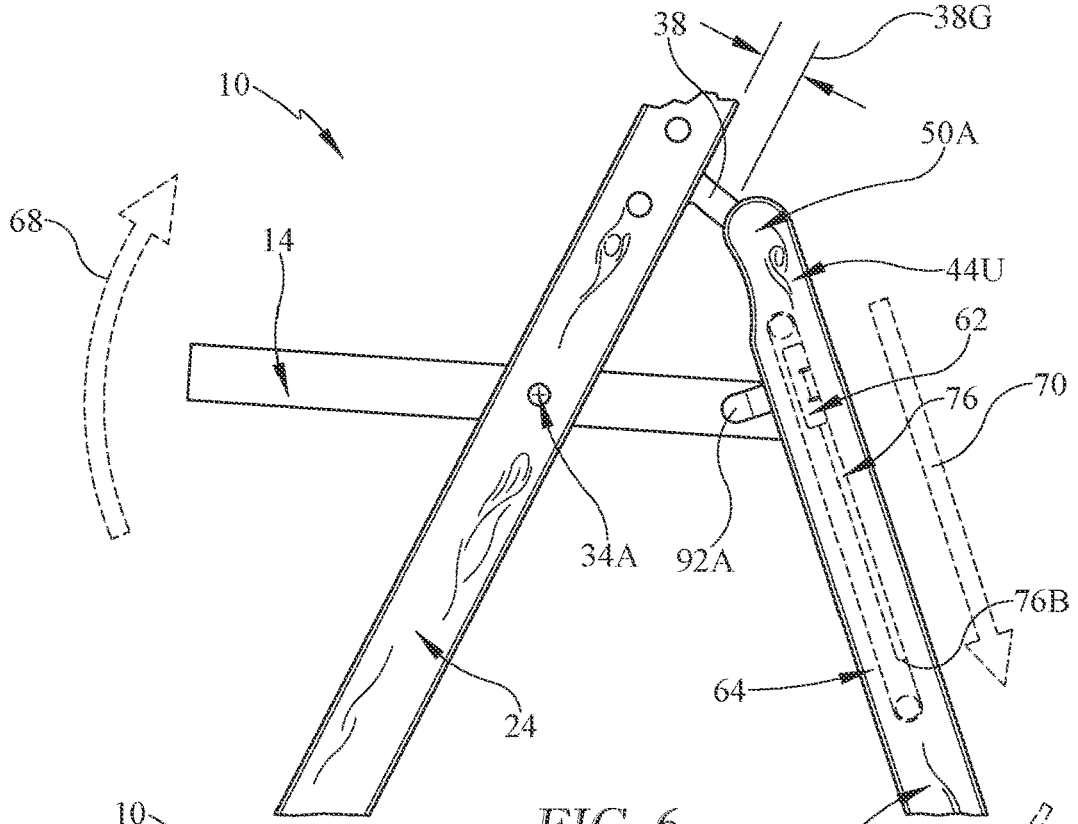
Figure 7:
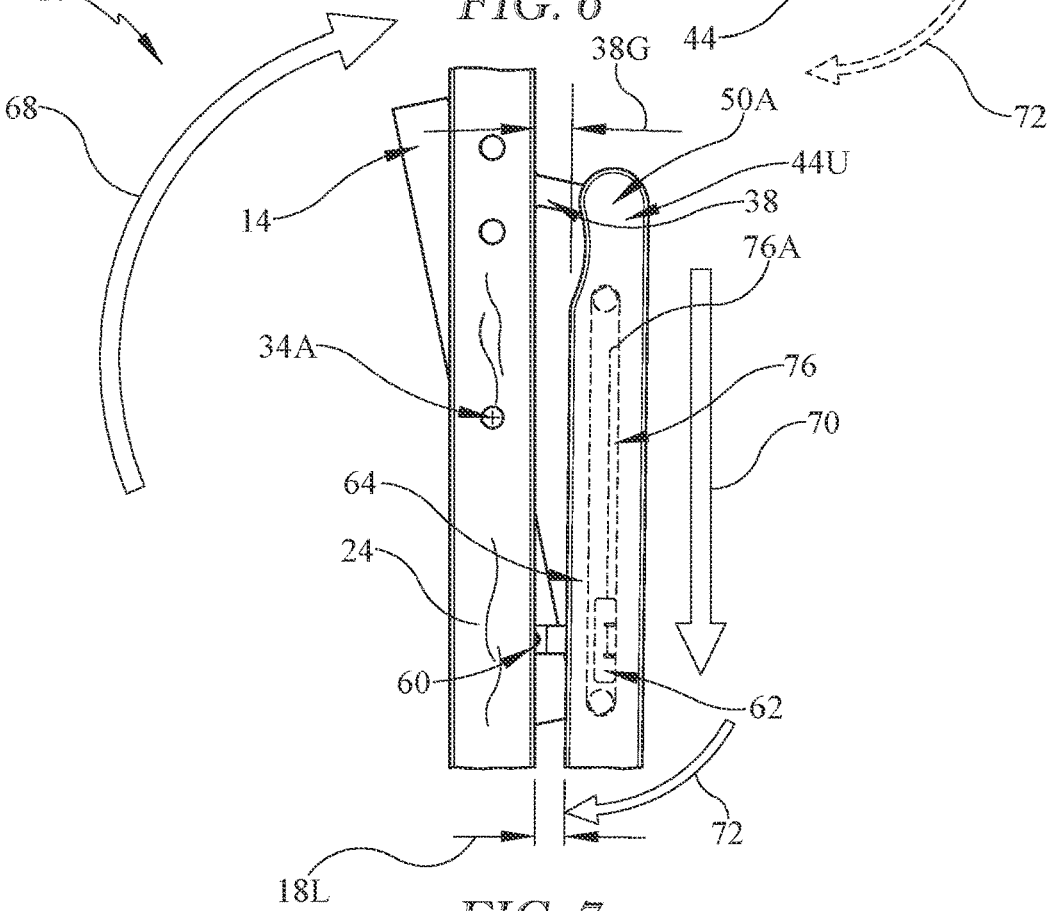
Figure 8:
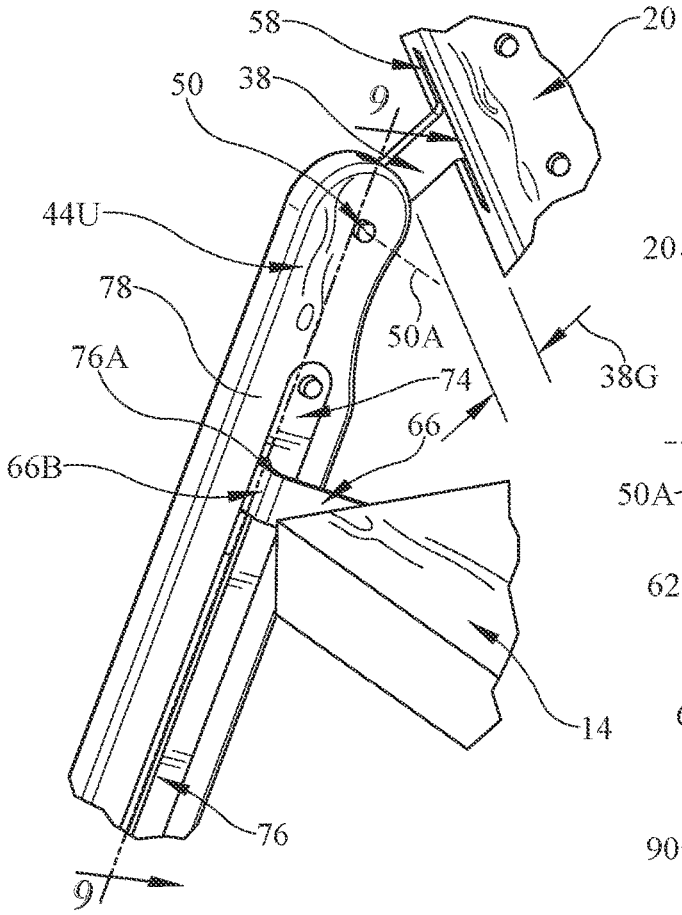
Figure 9:
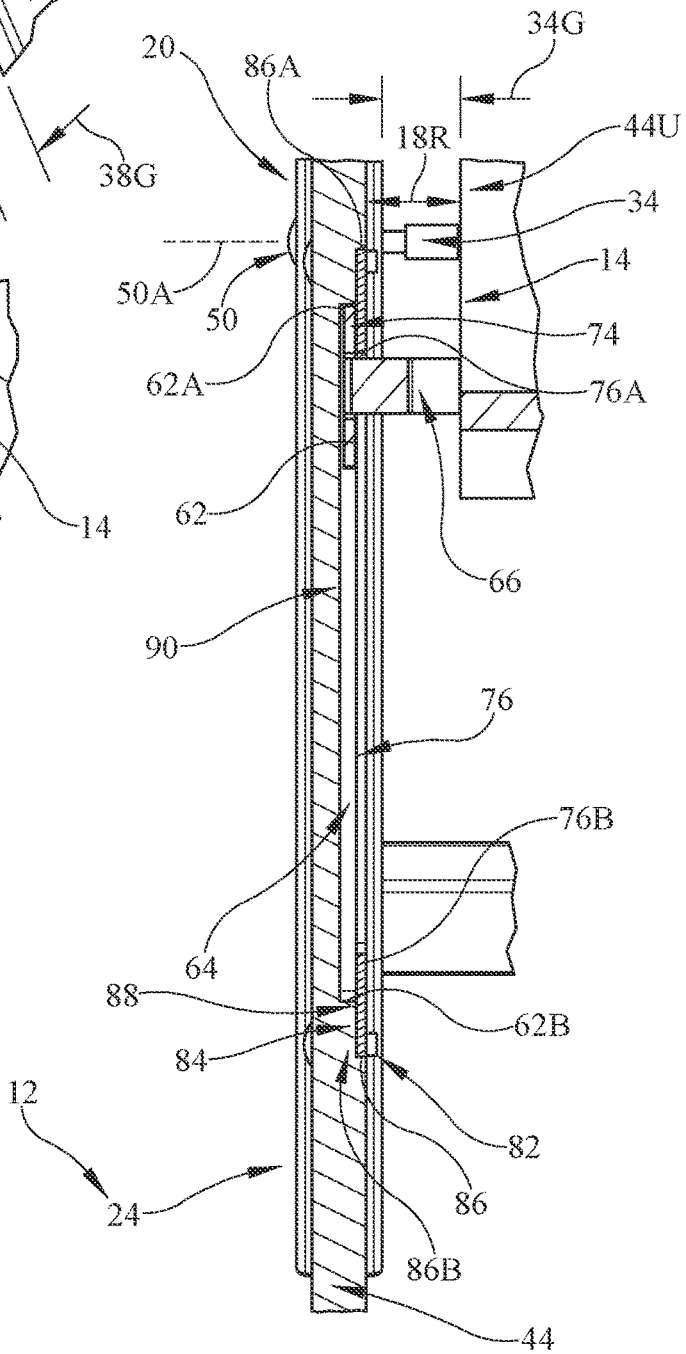
Figure 10:
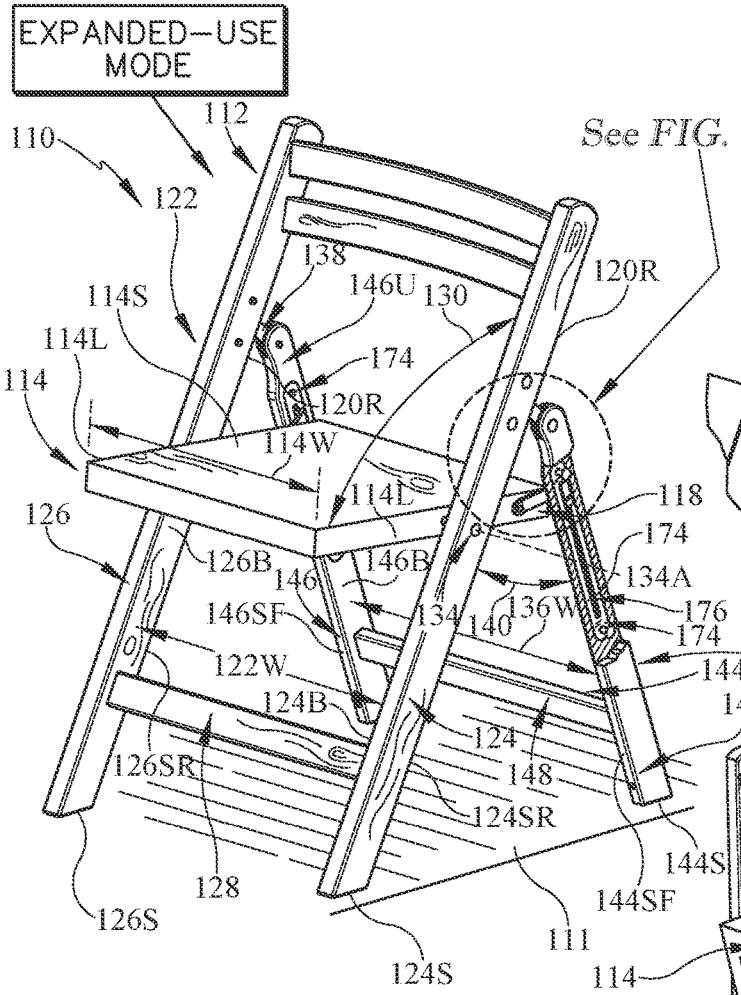
Figure 11A:
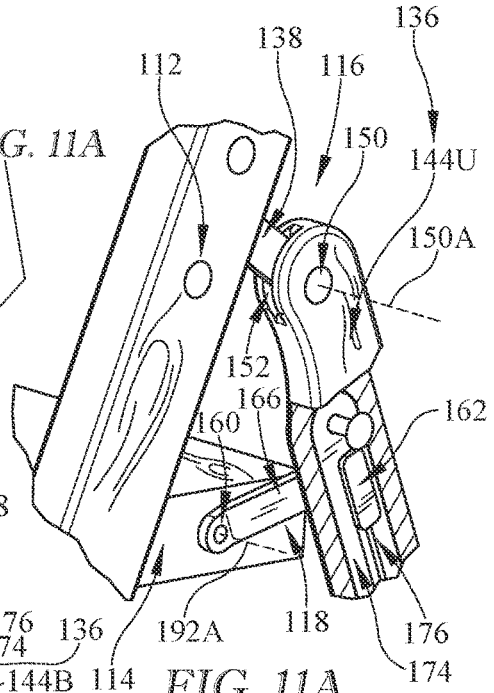
Figure 11:
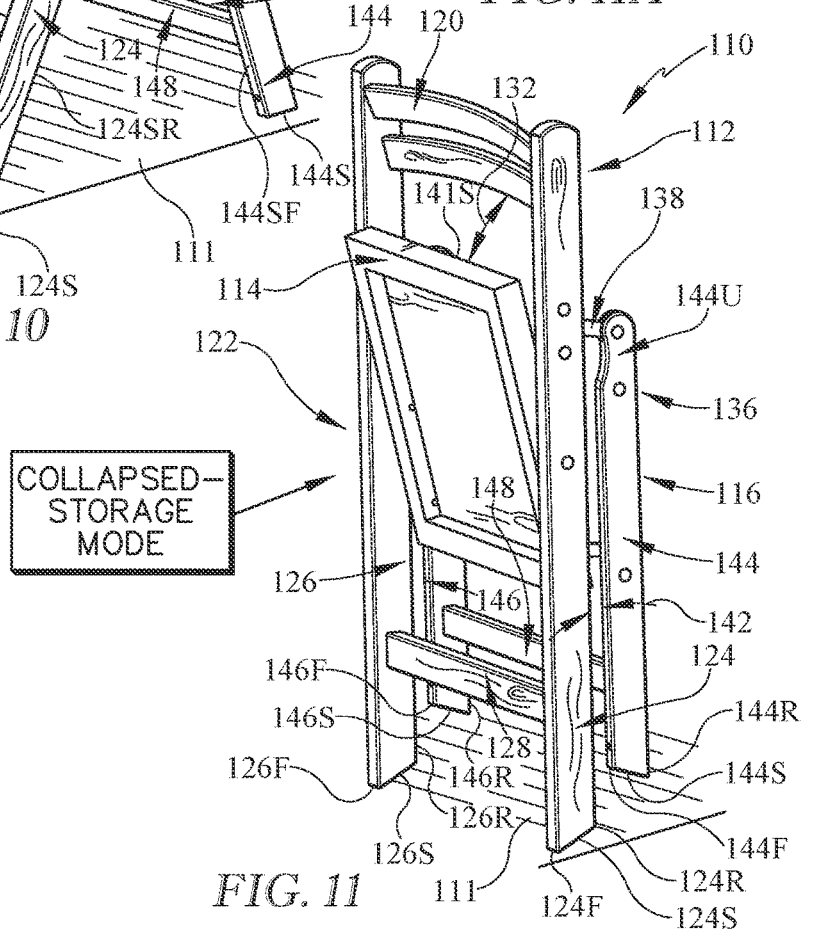
Figure 12:
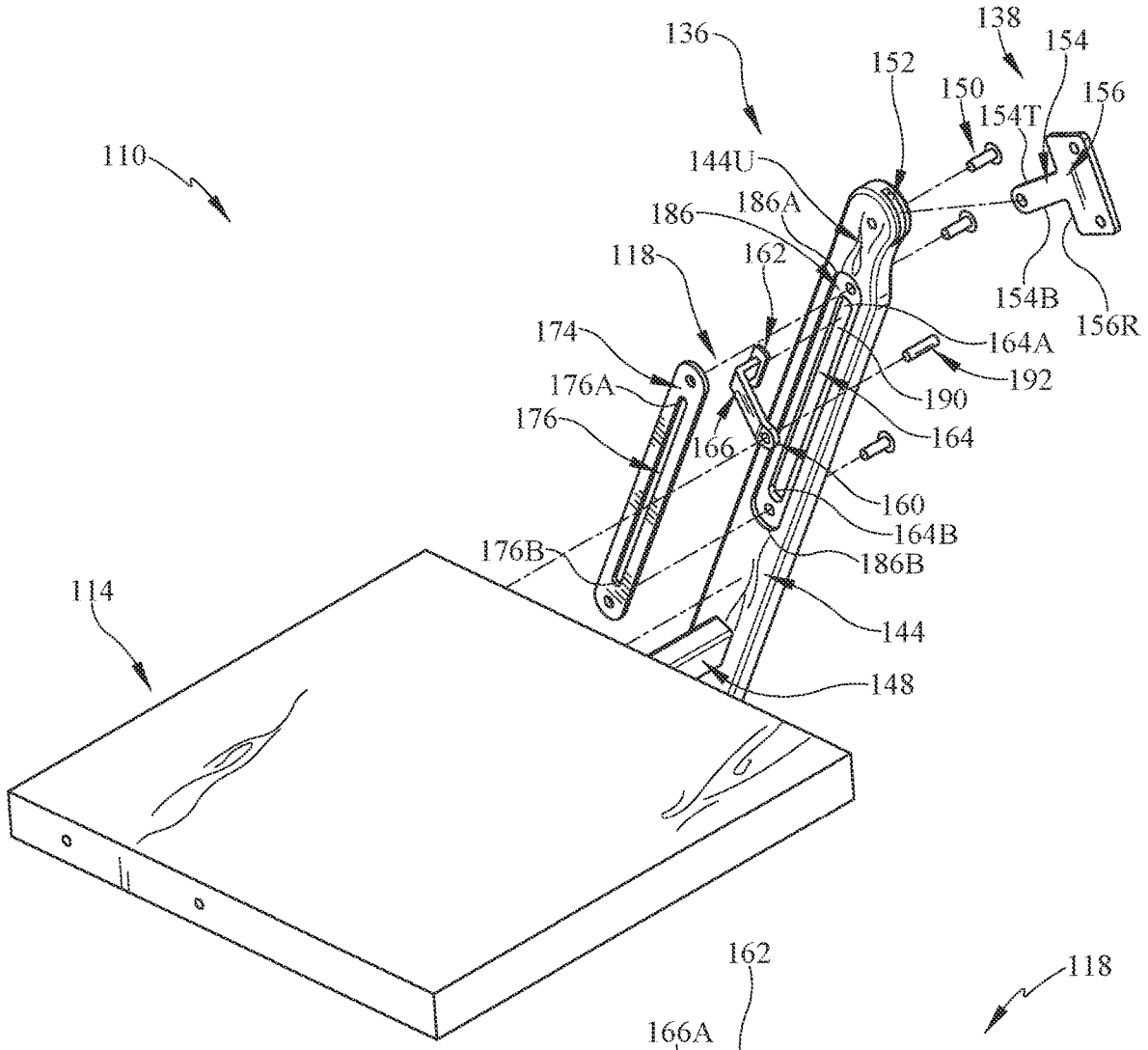
Figure 13:
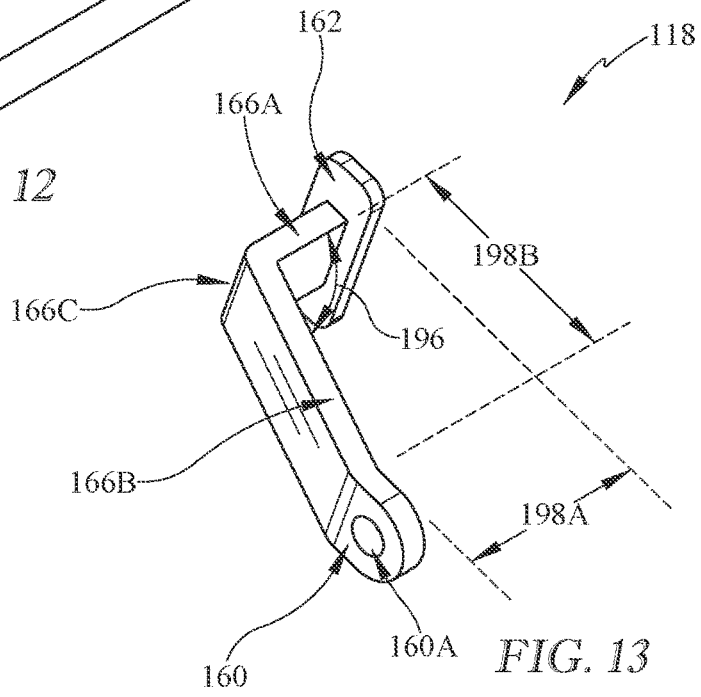
Figure 14:
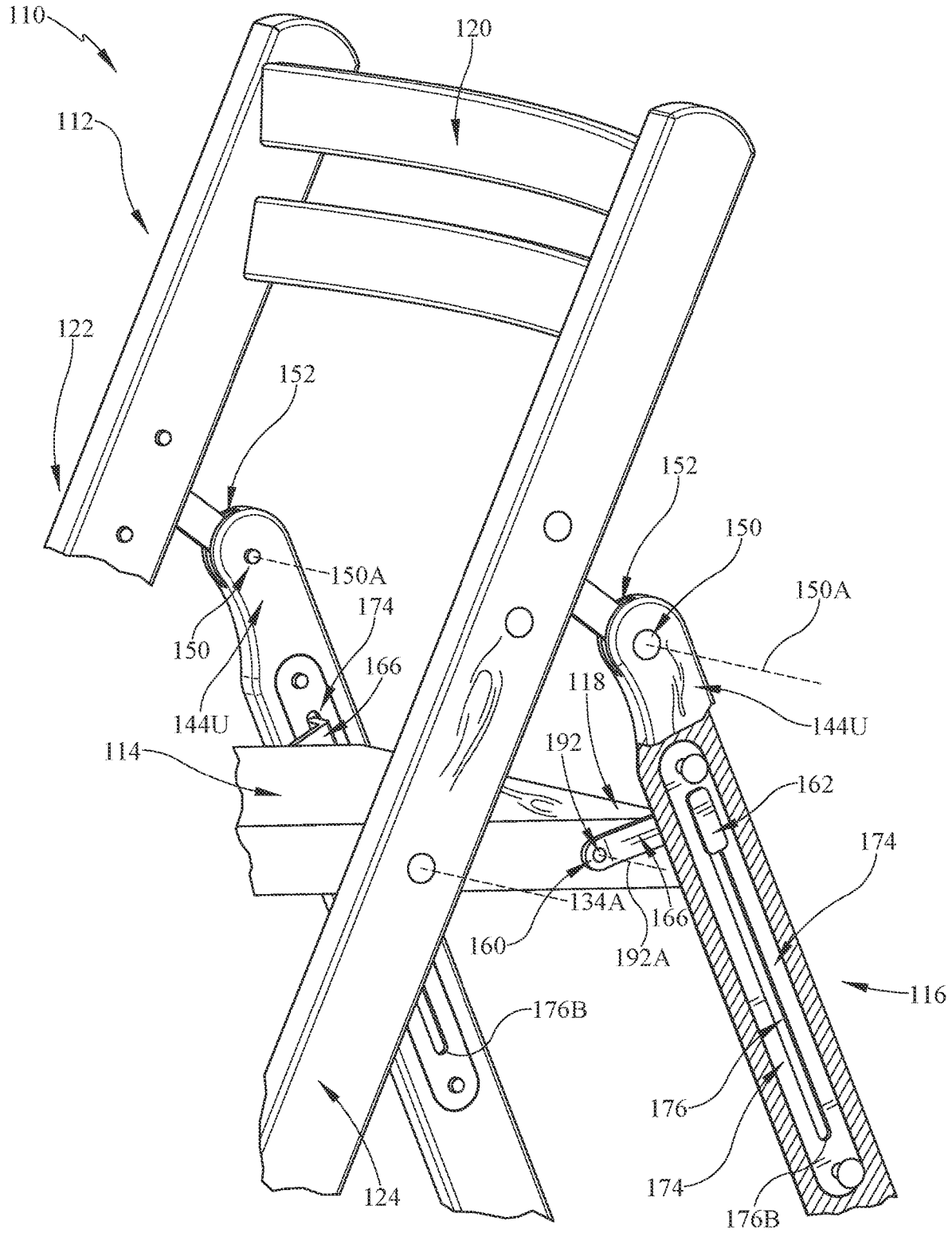
Figure 15:
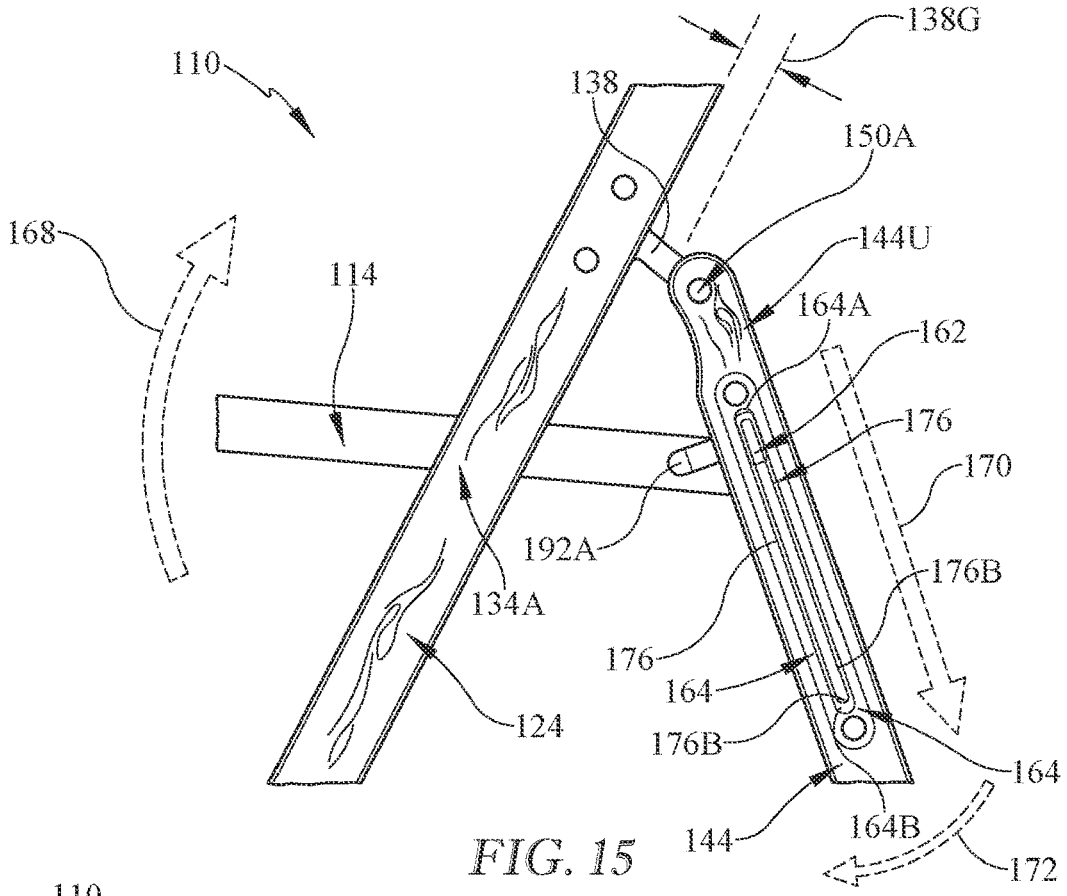
Figure 16:
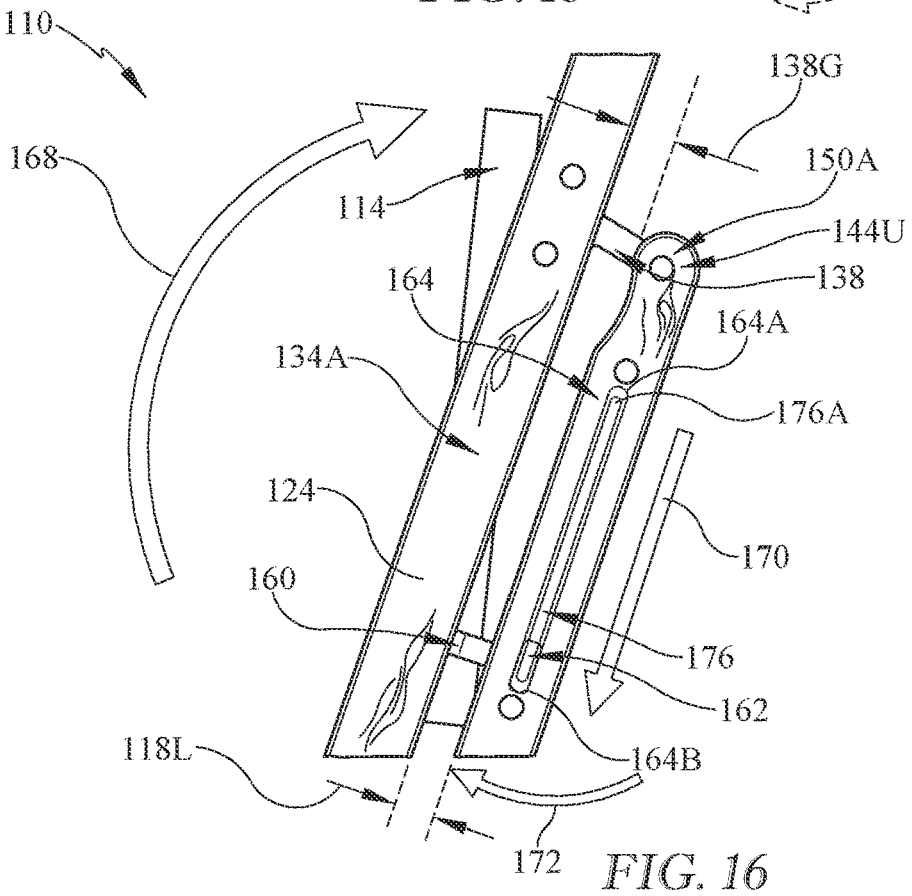
Figure 17:
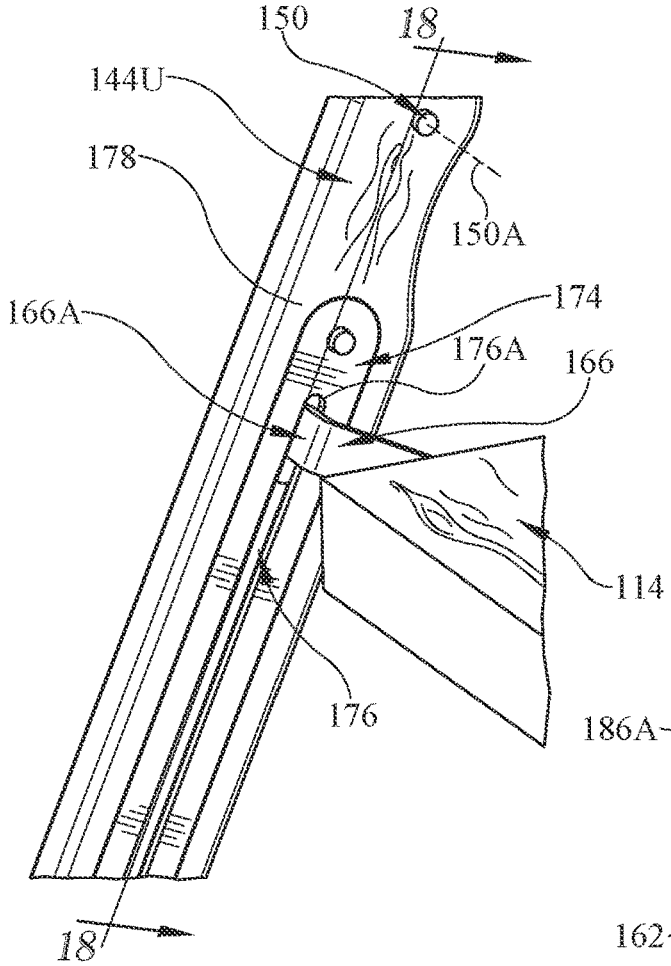
Figure 18:
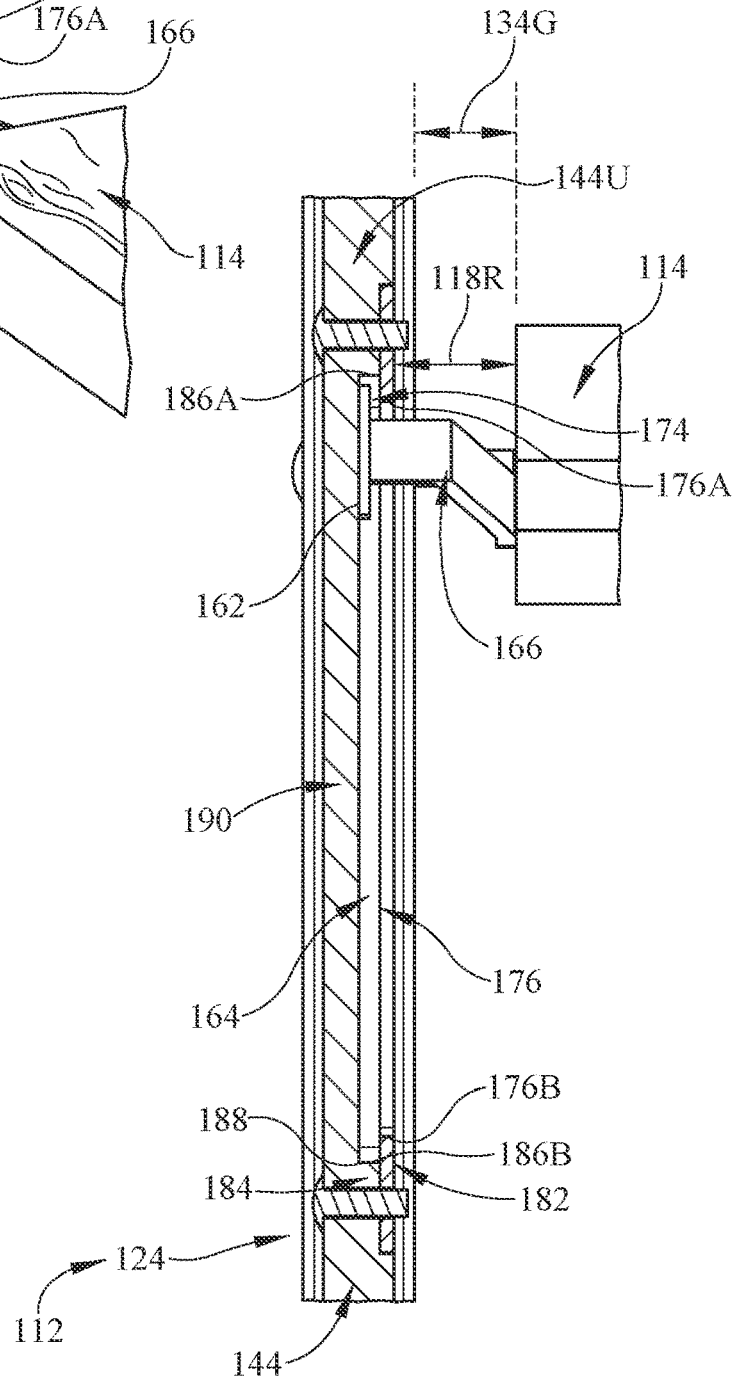
Figure 21:
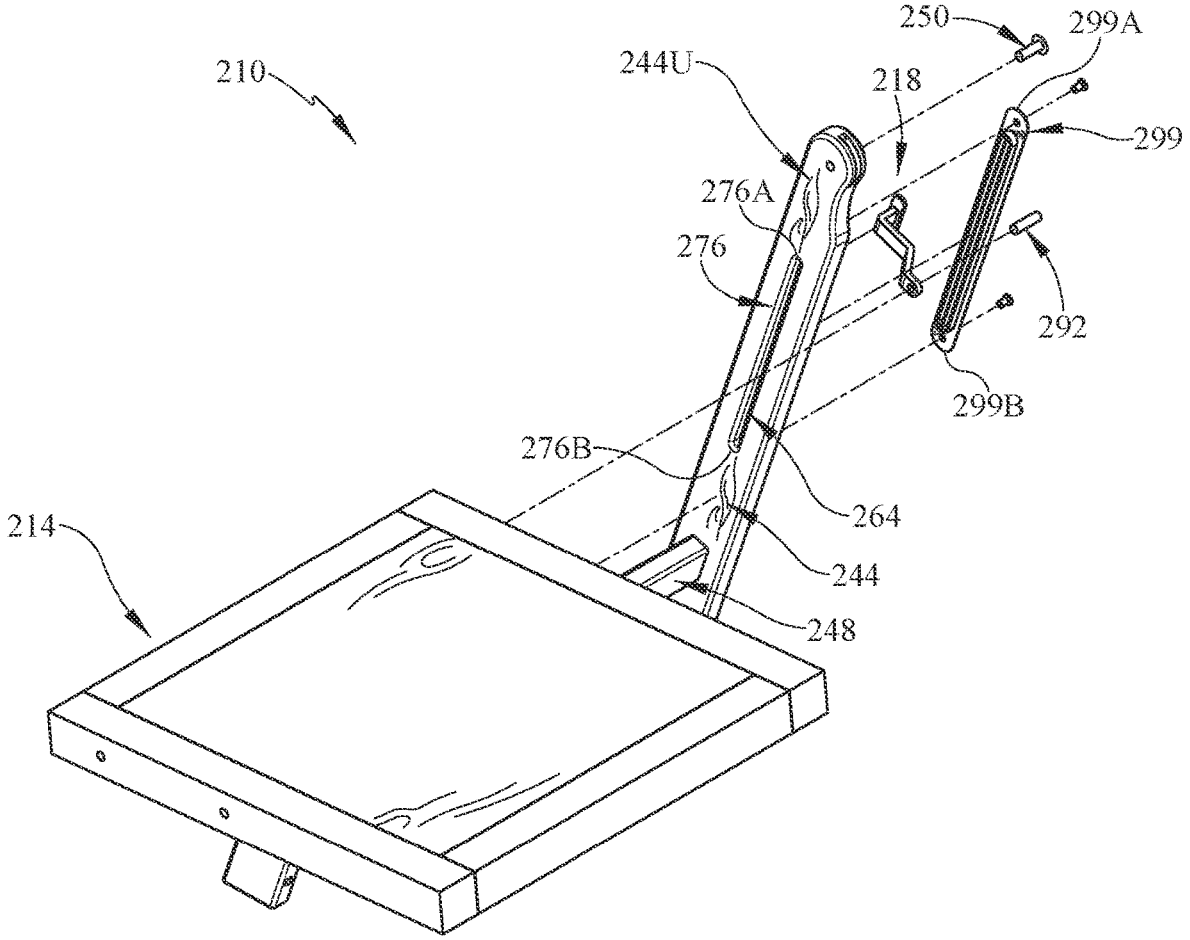
Figure 22:
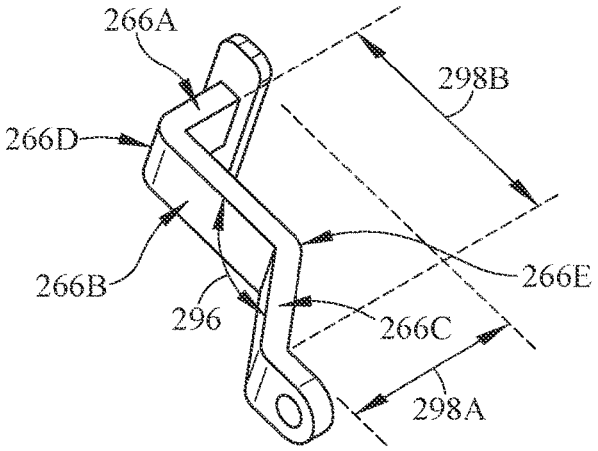
Figure 23:
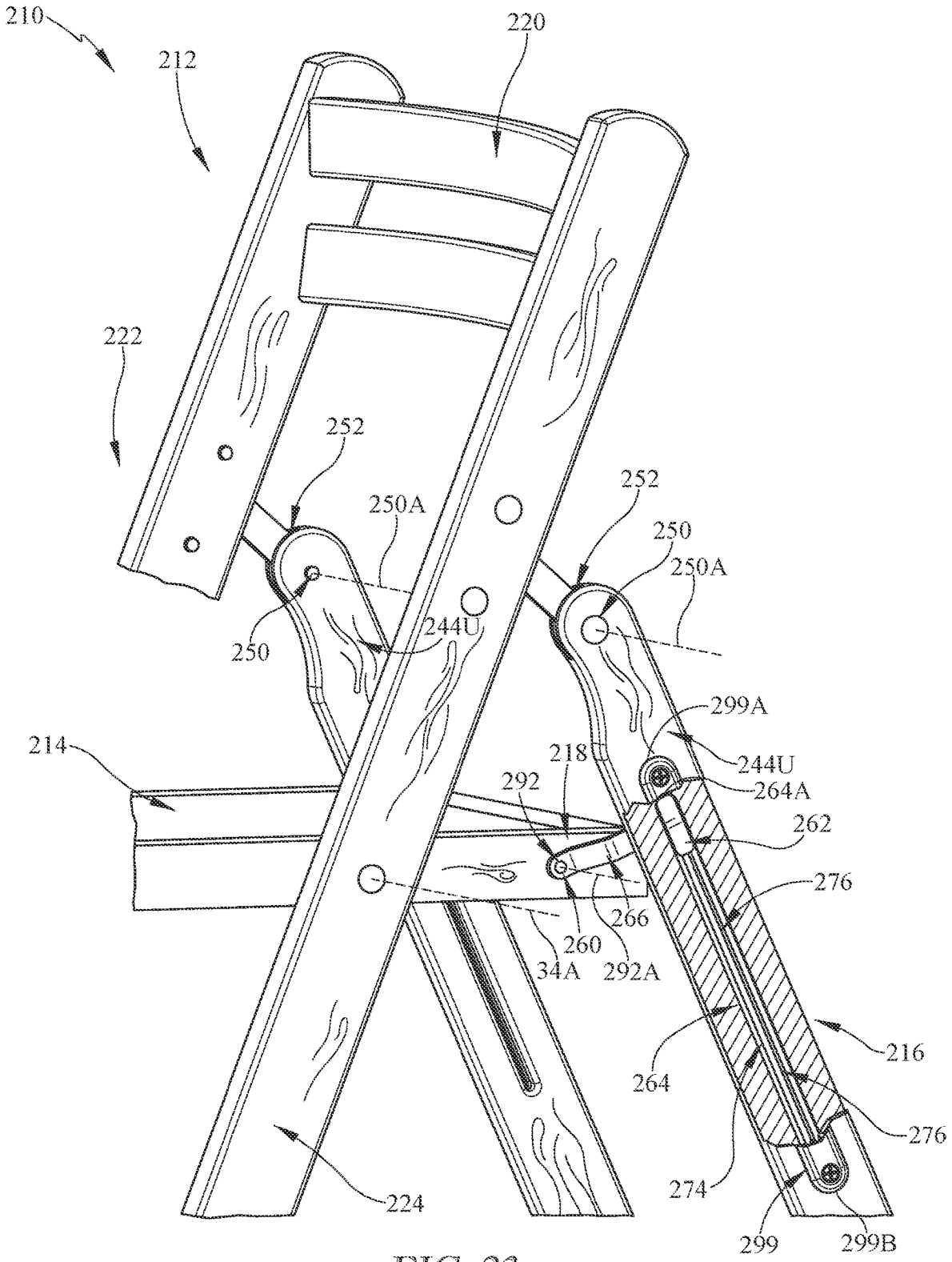
Figure 24:
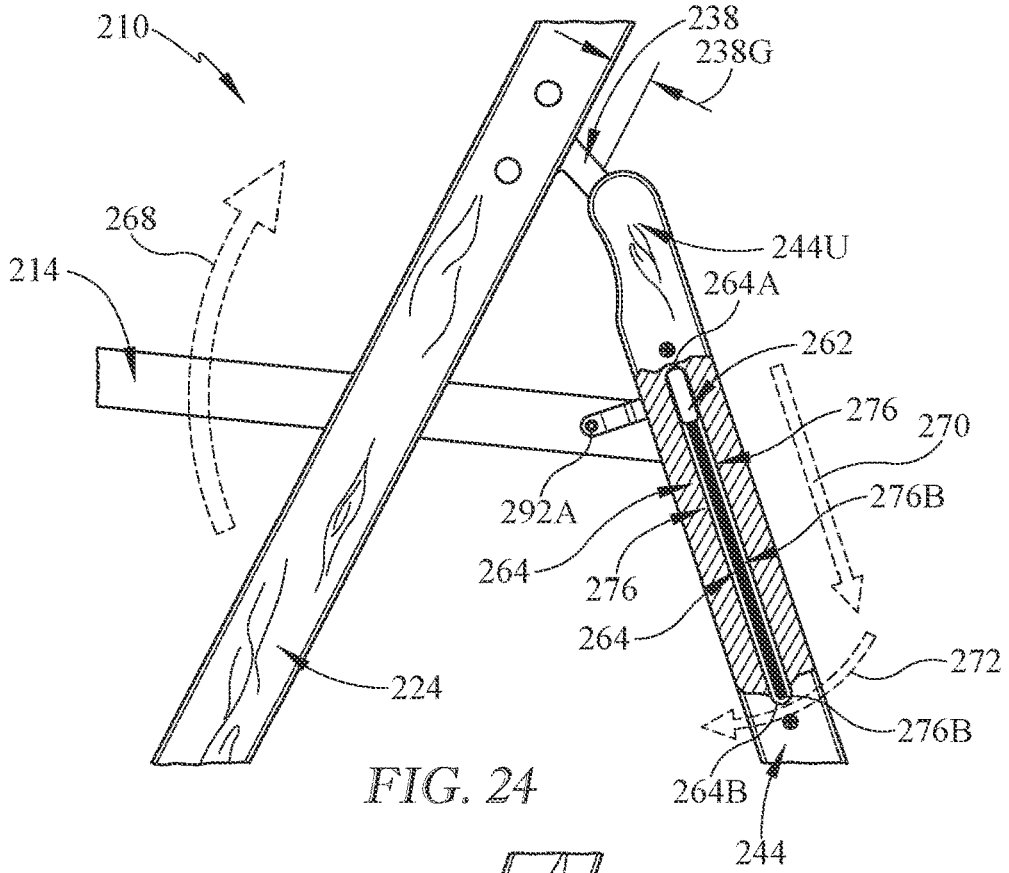
Figure 25:
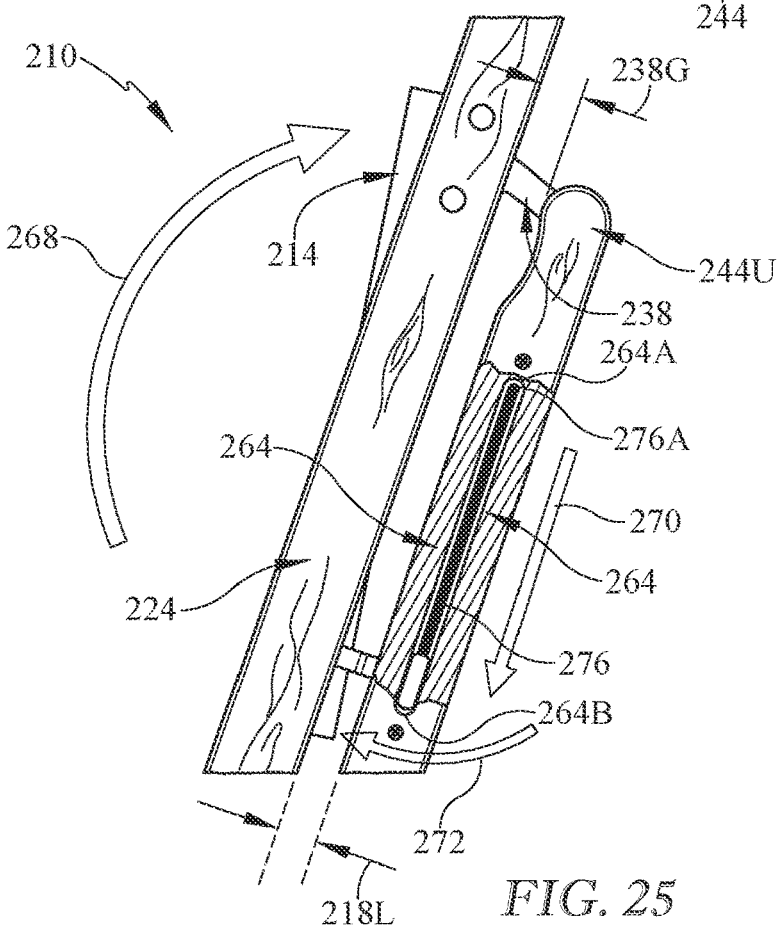
Figure 26:
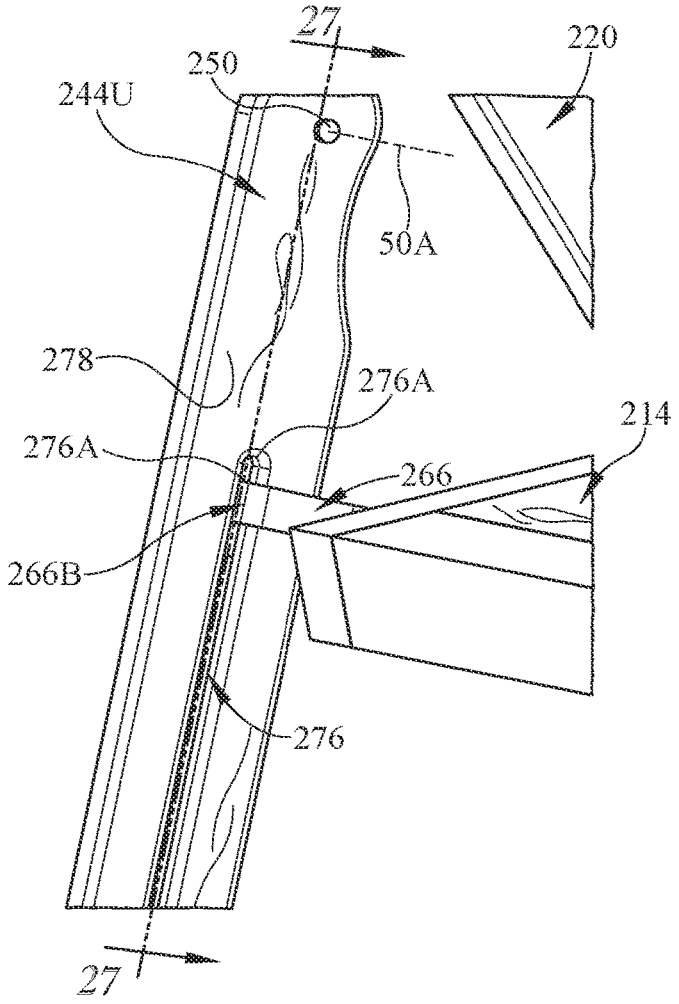
Figure 27:
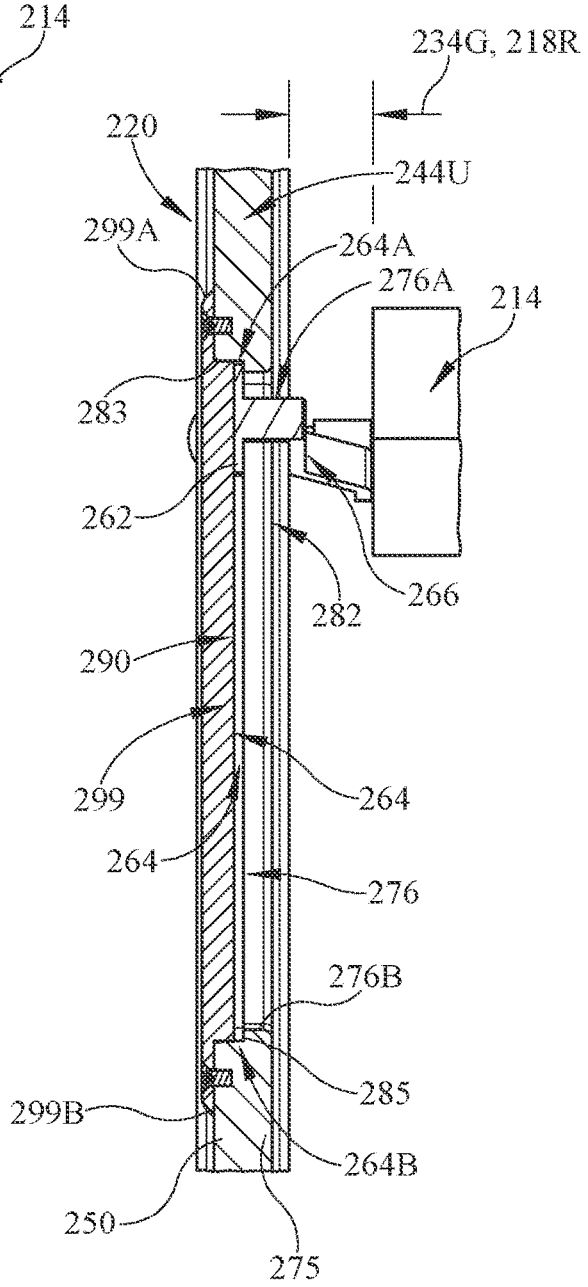
Figure 28:
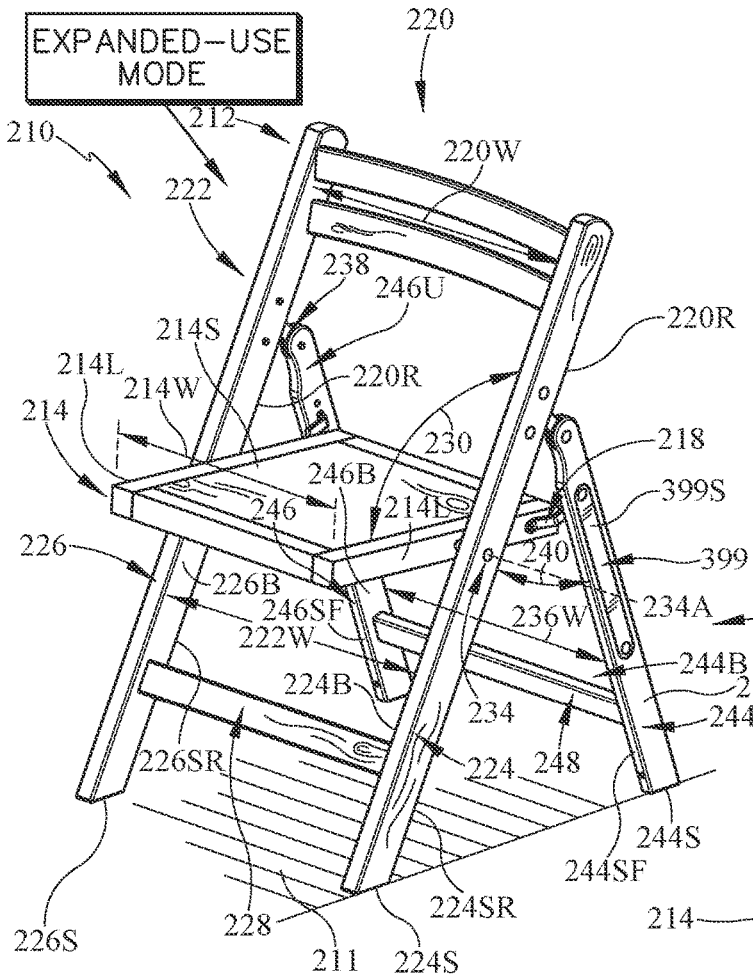
Figure 29:
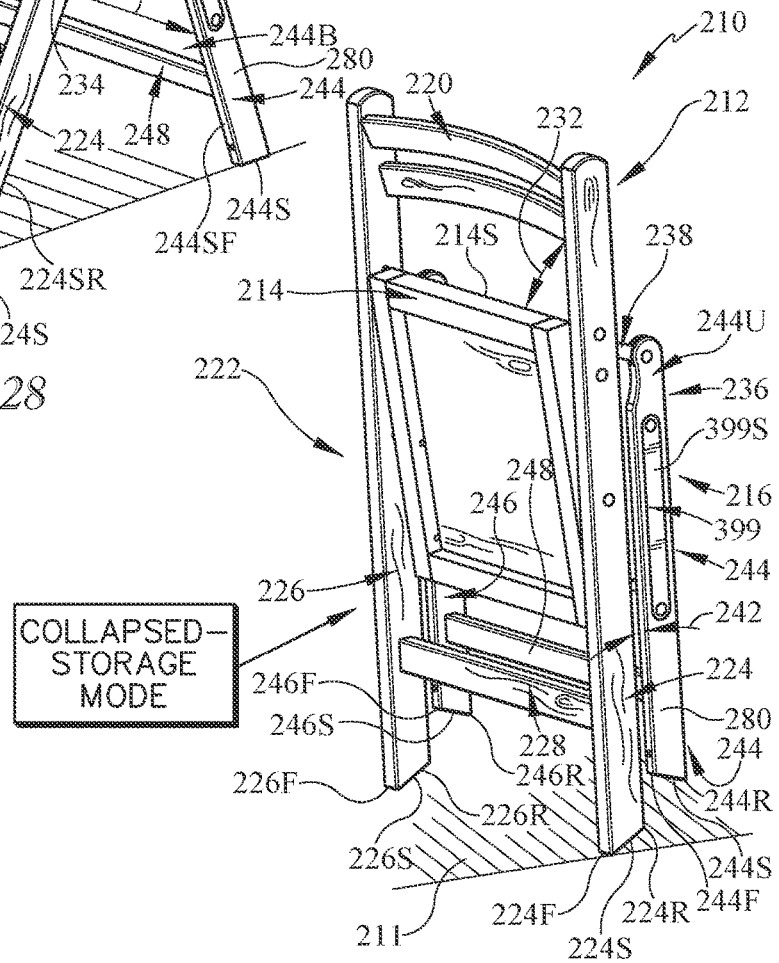

FIG. 3 is a partial exploded view of the foldable chair of FIG. 1 showing that the rear-leg unit is formed to include the slide passageway that receives the slider of the rear-leg driver and that the rear-leg unit further includes a cover plate formed to include a rod passageway that receives at least a portion of the connecting rod so that the slider slides in the slide passageway and the connecting rod slides in the rod passageway as the rear-leg unit is moved;

FIG. 4A is a rear view of the rear-leg driver of FIG. 1 showing that the rear-leg driver is made from a single, monolithic stamped and pressed metallic sheet;

FIG. 4B is a rear-view of the rear-leg driver of FIG. 1 showing that the slider and the connecting rod cooperate to define a pair of slots that facilitate pressing of the slider, each of the slots positioned between an inner surface of the slider and an outer surface of the connecting rod and showing that at least some of the connecting rod is bent away from the slider towards the pivot mount;

FIG. 4C is a top view of the rear-leg driver of FIG. 1 showing that the slider and the pivot mount are arranged on parallel planes and that the connecting rod establishes various offsets between the pivot mount and the slider;

FIG. 5 is a detailed perspective view of the foldable chair of FIG. 1 broken away to show that the rear-leg unit includes a rear leg and a rear-leg offset interconnecting the seat back and the rear leg so that an upper end of the rear leg is in spaced apart relation to the seat back;

FIG. 6 is a side view of the foldable chair of FIG. 1 showing that the slider of the rear-leg driver is positioned at an upper end of the slide passageway when the foldable chair is in the expanded-use mode;

FIG. 7 is a side view of the foldable chair of FIG. 1 showing that the rear-leg driver drives the rear-leg unit toward the front-leg unit in response to pivoting movement of the seat bottom toward the seat back to establish the collapsed-storage mode of the foldable chair, and further showing that the slider of the rear-leg driver is positioned at a lower end of the slide passageway when the foldable chair is in the collapsed-storage mode;

FIG. 8 is a detailed mar perspective view of the foldable chair of showing that a second planar segment of the connecting rod of the rear-leg driver is positioned at an upper end of the rod passageway when the foldable chair is in the expanded-use mode;

FIG. 9 is a section view taken along line 9-9 of FIG. 8 showing that a length of the rod passageway established between the upper end and a lower end of the rod passageway is less than a length of the slide passageway established between the upper end and the lower end of the slide passageway such that both the upper end and the lower end of the rod passageway are spaced vertically inward relative to the upper end and the lower end of the slide passageway;

FIG. 10 is a perspective view of another embodiment of a foldable chair broken away to show that the foldable chair includes a front-leg unit having a seat back and a front leg coupled to the seat back, a seat bottom mounted on the front-leg unit, a rear-leg unit mounted on the seat back for pivotable movement relative to the front-leg unit during folding and unfolding of the foldable chair, and a rear-leg driver that drives the rear-leg unit away from the front-leg unit in response to pivoting movement of the seat bottom to establish an expanded-use mode of the foldable chair in which the seat bottom is supported in a substantially horizontal orientation to seat an occupant;

FIG. 11A is detailed view of the foldable chair of FIG. 10 broken away to show that the rear-leg driver includes a pivot mount that is coupled to a rear portion of the seat bottom, a slider that is adapted to be placed in a slide passageway formed to extend along a length of the rear-leg unit, and a connecting rod interconnecting the pivot mount and the slider, FIG. 11 is a perspective view of the foldable chair of FIG. 10 showing that the rear-leg driver drives the rear-leg unit toward the front-leg unit in response to pivoting movement of the seat bottom to establish a collapsed-storage mode of the foldable chair in which the seat bottom is supported in a substantially vertical orientation;

FIG. 12 is a partial exploded view of the foldable chair of FIG. 10 showing that the rear-leg unit is formed to include a slide passageway that receives the slider of the rear-leg driver and that the rear-leg unit further includes a cover plate formed to include a rod passageway that receives at least a portion of the connecting rod so that the slider slides in the slide passageway and the connecting rod slides in the rod passageway as the rear-leg unit is moved;

FIG. 13 is a rear perspective view of the rear-leg driver of FIG. 10 showing that the connecting rod is machined to the slider and further showing that the connecting rod establishes various offsets between the slider and the pivot mount;

FIG. 14 is a detailed perspective view of the foldable chair of FIG. 10 broken away to show that the rear-leg unit includes a rear leg and a rear-leg offset interconnecting the seat back and the ear leg so that an upper end of the rear leg is in spaced apart relation to the seat back;

FIG. 15 is a side view of the foldable chair of FIG. 10 showing that the slider of the rear-leg driver is positioned at an upper end of the slide passageway when the foldable chair is in the expanded-use mode;

FIG. 16 is a side view of the foldable chair of FIG. 10 showing that the rear-leg driver drives the rear-leg unit toward the front-leg unit in response to pivoting movement of the seat bottom toward the seat back to establish the collapsed-storage mode of the foldable chair, and further showing that the slider of the rear-leg driver moves to a lower end of the first in response to pivoting movement of the seat bottom toward the seat back to establish the collapsed-storage mode;

FIG. 17 is a detailed rear perspective view of the foldable chair of FIG. 10 showing that the slider-end of the connecting rod of the rear-leg driver is positioned at an upper end of the rod passageway when the foldable chair is in the expanded-use mode;

FIG. 18 is a section view taken along line 18-18 of FIG. 17 showing that a length of the rod passageway established between the upper end and a lower end of the rod passageway is less than a length of the slide passageway established between the upper end and the lower end of the slide passageway such that both the upper end and the lower end of the rod passageway are spaced vertically inward relative to the upper end and the lower end of the slide passageway;

FIG. 19 is a perspective view of another embodiment of a foldable chair broken away to show that the foldable chair includes a front-leg unit having a seat back and a front leg to the seat back, a seat bottom mounted on the front-leg unit, a rear-leg unit mounted on the seat back for pivotable movement relative to the front-leg unit during folding and unfolding of the foldable chair, and a rear-leg driver that drives the rear-leg unit away from the front-leg unit in response to pivoting movement of the seat bottom to establish an expanded-use mode of the foldable chair in which the seat bottom is supported in a substantially horizontal orientation to seat an occupant, and showing that the rear-leg unit further includes at least one plastic cap to cover an outer surface of a rear leg of the rear-leg unit to prevent access by a finger to a passageway formed in the rear-leg unit;

FIG. 19A is detailed cutaway view of the foldable chair of FIG. 19 broken away to show that the rear-leg driver includes a pivot mount that is coupled to a rear portion of the seat bottom, a slider that is adapted to be placed in a slide passageway formed to extend along a length of one of the rear legs in the rear-leg unit, and a connecting rod interconnecting the pivot mount and the slider;

FIG. 20 is a perspective view of the foldable chair of FIG. 19 showing that the rear-leg driver drives the rear-leg unit toward the front-leg unit in response to pivoting movement of the seat bottom to establish a collapsed-storage mode of the foldable chair in which the seat bottom is supported in a substantially vertical orientation;

FIG. 21 is a partial exploded view of the foldable chair of FIG. 19 showing that the rear-leg unit is formed to include a slide passageway that receives the slider of the rear-leg driver and a rod passageway that receives at least a portion of the connecting rod so that the slider slides in the slide passageway and the connecting rod slides in the rod passageway as the rear-leg unit is moved;

FIG. 22 is a rear perspective view of the rear-leg driver of FIG. 19 showing that the connecting rod is machined to the slider and that the connecting rod establishes various offsets between the slider and the pivot mount;

FIG. 23 is a detailed cutaway perspective view of the foldable chair of FIG. 19 broken away to show that the rear-leg unit includes a rear leg and a rear-leg offset interconnecting the seat back and the rear leg so that an upper end of the rear leg is in spaced apart relation to the seat back;

FIG. 24 is a cutaway side view of the foldable chair of FIG. 19 broken away to show that the slider of the rear-leg driver is positioned at an upper end of the slide passageway when the foldable chair is in the expanded-use mode;

FIG. 25 is a cutaway side view of the foldable chair of FIG. 19 broken away to show that the rear-leg driver drives the rear-leg unit toward the front-leg unit in response to pivoting movement of the seat bottom toward the seat back to establish the collapsed-storage mode of the foldable chair, and further showing that the slider of the rear-leg driver is positioned at a lower end of slide passageway when the foldable chair is in the collapsed-storage mode;

FIG. 26 is a detailed rear perspective view of the foldable chair of FIG. 19 showing that the connecting rod of the rear-leg driver is positioned at an upper end of the rod passageway when the foldable chair is in the expanded-use mode;

FIG. 27 is a section view taken along line 27-27 of FIG. 26 showing that a length of the rod passageway established between the upper end and a lower end of the rod passageway is less than a length of the slide passageway established between the upper end and the lower end of the slide passageway such that both the upper end and the lower end of the rod passageway are spaced vertically inward relative to the upper end and the lower end of the slide passageway;

FIG. 28 is a perspective view of another embodiment of a foldable chair in an expanded-use mode in which the cap is a metal cap instead of the plastic cap shown in FIGS. 19-27; and FIG. 29 is a perspective view of the foldable chair of FIG. 28 showing the foldable chair in a collapsed-storage mode.

DETAILED DESCRIPTION

For the purposes of promoting an understanding of the principles of the disclosure, reference will now be made to a number of illustrative embodiments illustrated in the drawings and specific language will be used to describe the same.

A foldable chair 10 in accordance with the present disclosure includes a driver 18 to adjust the foldable chair 10 from an expanded-use mode shown in FIGS. 1 and 1A to a collapsed-storage mode shown in FIG. 2. The foldable chair 10 includes features to prevent a finger of a user being pinched when adjusting the foldable chair 10 between the expanded-use mode and the collapsed-storage mode. A foldable chair 110 in accordance with a second embodiment of the present disclosure is shown in FIGS. 10-18. A foldable chair 210 having in accordance with a third embodiment of the present disclosure is shown in FIGS. 19-27. A variation of one of the components in foldable chair 210 is shown in FIGS. 28-29.

The foldable chair 10 includes a front-leg unit 12 and a seat bottom 14 mounted to the front-leg unit 12 for pivotable movement relative to the front-leg unit 12 during folding and unfolding of the foldable chair 10, as shown in FIGS. 1-2. The foldable chair 10 also includes a rear-leg unit 16 mounted on the front-leg unit 12 for pivotable movement relative to the front-leg unit 12 during folding and unfolding of the foldable chair 10, as shown in FIGS. 1-2. The foldable chair 10 further includes a rear-leg driver 18, shown in FIGS. 1 and 1A, configured to provide means for driving the rear-leg unit 16 away from the front-leg unit 12 in response to pivoting movement of the seat bottom 14 away from the front-leg unit 12 during unfolding of the foldable chair 10. The rear-leg driver 18 also provides means for driving the rear-leg unit 16 towards the front-leg unit 12 in response to pivoting movement of the seat bottom 14 towards the front-leg unit 12 during folding of the foldable chair 10. In the illustrative embodiment, the foldable chair 10 includes two rear-leg drivers 18.

The foldable chair 10 is adjustable between an expanded-use mode, shown in FIG. 1, in which the seat bottom 14 is supported in a substantially horizontal orientation to support an occupant and a collapsed-storage mode, shown in FIG. 2, in which the seat bottom 14 is supported in a substantially vertical orientation.

The front-leg unit 12 includes a seat back 20 and a front leg 22 coupled to the seat back 20 as shown in FIGS. 1-2. The seat back 20 is configured to support an occupant's back when the chair 10 is in the expanded-use mode. A user may also hold the seat back 20 to carry the chair 10 when it is in the collapsed-storage mode. The front leg 22 is integrally coupled to and is configured to move with the seat back 20 upon pivoting movement of the seat bottom 14. In the illustrative embodiment, the seat back 20 is coupled to the rear-leg unit 16.

In the illustrative embodiment, the front leg 22 is coupled to the seat bottom 14 as shown in FIGS. 1-2. The front leg 22 includes a first front-leg segment 24, a second front-leg segment 26 spaced apart from the first front-leg segment 24, and a front spacer 28 coupled to and interconnecting the first front-leg segment 24 and the second front-leg segment 26. The front spacer 28 defines an internal front-leg width 22W that is equal to a width 20W of the seat back 20. In other embodiments, the internal front-leg width 22W may be less than or greater than the seat-back width 20W.

Each front-leg segment 24, 26 has an angled bottom surface 245, 265, as shown in FIGS. 1-2. Each angled bottom surface 24S, 26S is configured to lie flat on a floor 11 when the foldable chair 10 is positioned upright relative to the floor 11 and is in the expanded-use mode. When the foldable chair 10 is positioned upright relative to the floor 11 and is in the collapsed-storage mode, a rear end 24R, 26R of each angled surface 24S, 26S is spaced apart from the floor 11 while a front end 24F, 26F of each angled surface 24S, 26S is in contact with the floor 11.

The seat bottom 14 is mounted to the first front-leg segment 24, the second front-leg segment 26, and the rear-leg drivers 18 as shown in FIGS. 1-2 for pivotable movement relative to the seat back 20. The seat bottom 14 is configured to support a user when the foldable seat 10 is in the expanded-use mode. The seat bottom 14 is movable from a horizontal-support position, shown in FIG. 1, in which a support surface 14S of the seat bottom 14 is separated from the seat back 20 by a support angle 30, to a vertical-stowed position, shown in FIG. 2, in which the support surface 14S is separated from the seat back 20 by a stowed angle 32. The support angle 30 is greater than the stowed angle 32. For example, the support angle 30 may be greater than 90 degrees and the stowed angle 32 may be less than 90 degrees.

The seat bottom 14 includes pivot axles 34 coupled to and interconnecting a middle portion of the seat bottom 14 and the first front-leg segment 24, and the seat bottom 14 and the second front-leg segment 26, respectively, such that the seat bottom 14 is positioned between the first front-leg segment 24 and the second front-leg segment 26. Accordingly, the seat bottom 14 has a width 14W that is less than the internal front-leg unit width 22W of the front-leg width 22W. The pivot axles 34 define a first pivot axis 34A about which the seat bottom 14 between the horizontal-supported position and the vertical-stowed position.

As shown in FIG. 9, the pivot axle 34 creates a gap 34G between the first front-leg segment 24 and the seat bottom 14 at the first pivot axis 34A when the seat bottom 14 is in both the horizontal-support position and the vertical-stowed position. The illustrative embodiment also includes the same configuration for the second front-leg segment 26 and the seat bottom 14. The gaps 34G between the front-leg segments 24, 26 and the seat bottom 14 is the same between the horizontal-support position and the vertical-stowed position, and is sized to be no less than 0.5 inches. Accordingly, when the seat bottom 14 is moved towards seat back 20 to establish the collapsed-storage mode, a finger which is approximately less than 0.5 inches may not be pinched between the seat bottom 14 and the front-leg unit 12. In the illustrative embodiment, the gaps 34G are defined between a bottom-facing surface 24B, 26B of each front-leg segment and leg-facing surfaces 14L of the seat bottom as shown in FIG. 1

The rear-leg unit 16 include a rear leg 36 and rear-leg offsets 38 coupled to an interconnecting the rear leg 36 and the seat back 20 as shown in FIGS. 1-2. The rear leg 36 is movable between an extended position in which the rear leg 36 is separated from the front leg 22 by an extended angle 40 and a retracted position in which the rear leg 36 is separated from the front leg 22 by a retracted angle 42. The rear-leg offsets 38 are configured to space apart the rear leg 22 and the seat back 20.

In the illustrative embodiment, the rear leg 36 is coupled to the seat back 20 via the rear-leg offset 38 and the seat bottom 14 via the rear-leg drivers 18 as shown in FIGS. 1-2 and 5. The rear leg 36 includes a first rear-leg segment 44, a second rear-leg segment 46 spaced apart from the first rear-leg segment 44, and a rear spacer 48 coupled to and interconnecting the first rear-leg segment 44 and the second rear-leg segment 46. The rear spacer 48 defines an internal rear-leg width 36W that is greater than the seat-bottom width 14W. In some embodiments, the internal rear-leg width 36W may be less than, equal to, or greater than the internal front-leg width 22W.

Each rear-leg segment 44, 46 has an angled bottom surface 44S, 46S, as shown in FIGS. 1-2. Each angled bottom surface 44S, 46S is configured to lie flat on the floor 11 when the foldable chair 10 is positioned upright relative to the floor 11 and is in the expanded-use mode. When the foldable chair 10 is positioned upright relative to the floor 11 and is in the collapsed-storage mode, a forward end 44F, 46F of each angled surface 44S, 46S is spaced apart from the floor 11 while a rear end 44R, 46R of each angled surface 44S, 46S is in contact with the floor 11.

The rear-leg unit 16 further includes pivot axles 50 that each define a second pivot axis 50A about which the rear leg 36 rotates relative to the rear-leg offsets 38, as shown in FIGS. 1-3. In the illustrative embodiment, an upper end 44U, 46U of each rear-leg segment 44, 46 is formed to include an offset aperture 52 adapted to receive an angled segment 54 of each respective rear-leg offset 38. Each pivot axle 50 feeds through the respective angled segment 54 and rear-leg segment 44, 46 so that the rear leg 36 is rotatable about the pivot axis 50A. Furthermore, each front-leg segment 24, 26 is formed to include a planar aperture 58, as shown in FIG. 8, that is adapted to receive a planar segment 56 of each respective rear-leg offset 38. Each planar segment 56 is fixed to the respective front-leg segment 24, 26. As shown in FIG. 3, the angled segment 54 is angled relative to a rear surface 56R of the planar segment 56 such that an angle between a top surface 54T of the angled segment 54 and the rear-surface 56R is greater than 90 degrees and an angle between a bottom surface 54B of the angled segment 54 and the rear surface 56R is less than 90 degrees.

The rear-leg offset 38 is configured to create an upper gap 380 between an upper end of the first rear-leg segment 44 and the seat back 20 at the second pivot axis 50A when the rear-leg unit 16 is in both the extended position and the retracted position. The illustrative embodiment also includes the same configuration for the second rear-leg segment 46 and the seat back 20. The gaps 38G between the seat back 20 and the upper ends 44U, 46U of the rear-leg segments 44, 46 are sized to be no less than approximately 0.5 inches in both the extended position and the retracted position of the rear-leg unit 16. Accordingly, when a user, such as a child, changes the foldable chair 10 from the expanded-use mode to the collapsed-storage mode, and vice versa, pinching of the child's finger between the seat back 20 and the rear-leg unit 16 is minimized. Specifically, when the rear-leg unit 16 is moved towards the front-leg unit 12 to establish the collapsed-storage mode, a finger which is approximately less than 0.5 inches may not be pinched between the seat back 20 and the rear-leg unit 16. In the illustrative embodiment, the gaps 38G are defined between a rear-facing surface 20R of the seat back 220 and a front-facing surface 44SF, 46SF of each rear-leg segment 44, 46.

The rear-leg driver 18 is configured to provide means for rotating the rear-leg unit 16 about the second pivot axis 50A and away from the front-leg unit 12 in response to pivoting movement of the seat bottom 14 about the first pivot axis 38A away from the seat back 20 to establish the expanded-use mode of the foldable chair 10 as shown in FIGS. 1 and 6. The rear-leg driver 18 is also configured to provide means for rotating the rear-leg unit 16 about the second pivot axis 50A and towards the front-leg unit 12 in response to pivoting movement of the seat bottom 14 about the first pivot axis 38A towards from the seat back 20 to establish the collapsed-storage mode of the foldable chair 10 as shown in FIGS. 2 and 7.

The rear-leg driver 18 includes at one end a pivot mount 60 that is coupled to a rear portion of the seat bottom 14, a slider 62 that is adapted to be placed in a slide passageway 64 formed to extend along a length of each of the rear-leg segments 44, 46, and a connecting rod 66 interconnecting the pivot mount 60 and the slider 62 as shown in FIGS. 3-13. The seat bottom 14 includes pivot axles 92 which couple the pivot mount 60 to the seat bottom 14 via a mount aperture 60A formed in the pivot mount 60. The pivot axles 92 define a pivot axis 92A, and the seat bottom 14 rotates about the pivot axis 92A to move the slider 62 along the slide passageway 64 when the foldable chair 10 is moved between the collapsed-storage mode and the expanded-use mode.

The rear-leg driver 18 of the illustrative embodiment is made from a single, monolithic stamped and pressed metallic sheet as suggested in FIGS. 4A-13. The slider 62 is planar and defines a plane of the original metallic sheet from which the rear-leg driver 18 is formed. The connecting rod 66 includes a first planar segment 66A which is generally coplanar with the slider 62, a second planar segment 66B that extends away from and defines a plane that is perpendicular to the plane of the slider 62, and a third planar segment 66C that extends away from and defines a plane that is separated from the plane of the second planar segment 66B by an angle 96 that is greater than 90 degrees. The connecting rod 66 also includes a first curved segment 66D that interconnects the first planar segment 66A and the second planar segment 66B, and a second curved segment that interconnects the second planar segment 66B and the third planar segment 66C. The pivot mount 60 is also planar and defines a plane that is parallel to the plane of the slider 62.

Accordingly, the connecting rod 66 is configured to create various gaps 98A, 98B between the pivot mount 60 and the slider 62 as shown in FIG. 13. The first driver gap 98A is defined between the parallel planes of the pivot mount 60 and the slider 62 and is no less than 0.5 inches so that the seat bottom 14 is spaced apart from the rear-leg unit 16. When the seat bottom 14 is moved towards seat back 20 to establish the collapsed-storage mode, a finger which is approximately less than 0.5 inches may not be pinched between the seat bottom 14 and the rear-leg unit 16. As shown in FIG. 9, the first driver gap 98A defines a rear gap 18R between the seat bottom and each respective rear leg 44, 46. The rear gap 18R cooperates with the gap 34G to separate the leg-facing surface 14L of the seat bottom 14 from the bottom-facing surfaces 24B, 26B of the front-leg unit 12 and the bottom-facing surfaces 44B, 46B of the rear-leg unit 16 no less than 0.5 inches. Accordingly, a finger sized smaller than the gaps 18R, 34G cannot be pinched between the seat bottom 14 and the front and rear-leg units 12, 16 when the foldable chair 10 is moved from the expanded-use mode to the collapsed-storage mode.

The second driver gap 98B is defined between a plane perpendicular to the pivot mount 60 at the mount aperture 60A and the plane of the second planar segment 66B. The second driver gap 98B is no less than 0.5 inches so that the rear-leg segments 44, 46 are spaced apart from the respective front-leg segments 24, 26. When the seat bottom 14 is moved towards the seat back 20 to establish the collapsed-storage mode, a finger which is approximately less than 0.5 inches may not be pinched between the rear-leg segments 44, 46 and the respective front-leg segments 24, 26. As shown in FIG. 7, the second driver gap 98B defines a lower gap 18L between a rear-facing surface 24SR, 26SR of each respective front leg 24, 26 and the front-facing surface 44SF, 46SF of each rear leg 44, 46 when the rear-leg unit 16 is in the retracted position. The lower gap 18G cooperates with the upper gap 38G to separate the front-leg unit 12 from the rear-leg unit 16 no less than 0.5 inches. Accordingly, a finger sized smaller than the gaps 18L, 38G cannot be pinched between the front and rear-leg units 12, 16 when the foldable chair 10 is moved from the expanded-use mode to the collapsed-storage mode.

The rear-leg driver 18 further includes a pair of slots 94A, 94B that facilitate pressing of the slider as shown in FIGS. 4A and 4B. The slider 62 includes an upper inner surface 62U and a lower inner surface 62L spaced vertically from the upper inner surface 62U. The first planar segment 66A includes an upper outer surface 66U and a lower outer surface 66L spaced vertically from the upper outer surface 66U. The first slot 94A is defined between the upper inner surface 62U and upper outer surface 66U, and the second slot 94B is defined between the lower outer surface 66L and the lower inner surface 62L.

To move the foldable chair 10 from the expanded-use mode to the collapsed-storage mode, the seat bottom 14 rotates in a first direction 68 towards the seat back 20 about the first pivot axis 34A to rotate the pivot mount 60 about the third pivot axis 92A and push the slider 62 in a second direction 70 away from the seat back 20 so that the rear leg 36 rotates about the second pivot axis 50A in a third direction 72 towards the front leg 22 as shown in FIGS. 6 and 7.

Turning back to the rear-leg unit 16, each rear-leg segment 44, 46 is formed to include the slide passageway 64 as shown in FIG. 9. In the illustrative embodiment, the slide passageway 64 is positioned between the rear-leg offset 38 and the rear spacer 48. The rear-leg unit 16 further includes cover plates 74 fixed to each rear-leg segment 44, 46 and formed to include a rod passageway 76 configured to receive at least a portion of the connecting rod 66 so that the connecting rod 66 slides in the rod passageway 76 as the foldable chair 10 is moved between the expanded-use mode and the collapsed storage mode. In the illustrative embodiment, the rod passageway 76 has an open end such that a portion of the rod 66 is positioned between the cover plate 74 and the respective rear-leg segment 44, 46. The rod passageway 76 is sized to have a width of less than approximately 0.2 inches to prevent access of a finger being inserted in the rod passageway 76 and being pinched by the rear-leg driver 18.

Each rear-leg segment 44, 46 includes an inner surface 78 facing the seat bottom 14 and an outer surface 80 opposite the inner surface 78 facing away from the seat bottom 14 as shown in FIG. 9. A portion of the inner surface 78 forms an opening 82 and a plate wall 84 is positioned between the inner surface 78 and the outer surface 80 to form a plate-receiving aperture 86. Accordingly, the cover plate 74 is fixed between the inner surface 78 and the plate wall 84. Similarly, a portion of the plate wall 84 forms an opening 88 and a slider wall 90 is positioned between the plate wall 84 and the outer surface 80 to form the slide passageway 64.

In the illustrative embodiment shown in FIG. 9, a length of the slide passageway 64 is defined between an upper end 64A and a lower end 64B of the slide passageway 64. A length of the plate-receiving aperture 86 is defined between an upper end 86A and a lower end 86B of the plate-receiving aperture 82. Finally, a length of the rod passageway 76 is defined between an upper end 76A and a lower end 76B of the rod passageway 76. The plate-receiving aperture 86 length is greater than the slide passageway 64 length such that the upper end 86A is positioned above the upper end 64A and the lower end 86B is positioned below the lower end 64B so that the cover plate 74 can be fixed to the plate wall 80.

The rod passageway 76 length is less than the slide passageway 64 length such that the upper end 76A is positioned below the upper end 64A and the lower end 76B is positioned above the lower end 64B as shown in FIG. 9. The distance between the upper ends 64A, 76A and the distance between the lower ends 64B, 76B is sized such that the connecting rod 66 is in confronting relation to the upper end 76A when the foldable chair 10 is in the expanded-use mode and in confronting relation to the lower end 76B when the foldable chair 10 is in the collapsed-storage mode. As discussed above, the rod passageway 76 is sized such that the width is less than approximately 0.2 inches so that a finger cannot be pinched between the connecting rod 66 and the upper and lower ends 76A, 76B of the rod passageway 76.

In the illustrative embodiment, the front-leg unit 12, the seat bottom 14, and the rear-leg unit 16 may be made from wood, such as hardwood, softwood, engineered wood, or any type of wood suitable for furniture, including but not limited to, pine, cedar, fir, and spruce. The rear-leg driver 18 and the cover plate 74 may be made from metal, such as steel, titanium, aluminum, or any other metal or alloy suitable for furniture.

Another embodiment of a foldable chair 110 is shown in FIGS. 10-18. The foldable chair 110 is similar to the foldable chair 10 shown in FIGS. 1-9 and described herein. Accordingly, similar reference numbers in the 100 series indicate features that are common between the foldable chair 110 and the foldable chair 10. The description of the foldable chair 10 is incorporated by reference to apply to the foldable chair 110, except in instances when they conflict with the specific description and the drawings of the foldable chair 110. Specifically, the rear-leg driver 118 is formed from two metallic pieces machined together and the rod passageway 176 is centered in the cover plate 174 to receive a portion of the connecting rod 166.

The foldable chair 110 includes a front-leg unit 112 and a seat bottom 114 mounted to the front-leg unit 112 for pivotable movement relative to the front-leg unit 112 during folding and unfolding of the foldable chair 110, as shown in FIGS. 10-11. The foldable chair 110 also includes a rear-leg unit 116 mounted on the front-leg unit 112 for pivotable movement relative to the front-leg unit 112 during folding and unfolding of the foldable chair 110, as shown in FIGS. 10-11. The foldable chair 110 further includes a rear-leg driver 118, shown in FIGS. 10 and 11A, configured to provide means for driving the rear-leg unit 116 away from the front-leg unit 112 in response to pivoting movement of the seat bottom 114 away from the front-leg unit 112 during unfolding of the foldable chair 110. The rear-leg driver 118 also provides means for driving the rear-leg unit 116 towards the front-leg unit 112 in response to pivoting movement of the seat bottom 114 towards the front-leg unit 112 during folding of the foldable chair 110. In the illustrative embodiment, the foldable chair 110 includes two rear-leg drivers 118.

The foldable chair 110 is adjustable between an expanded-use mode, shown in FIG. 10, in which the seat bottom 114 is supported in a substantially horizontal orientation to support an occupant and a collapsed-storage mode, shown in FIG. 11, in which the seat bottom 114 is supported in a substantially vertical orientation.

The front-leg unit 112 includes a seat back 120 and a front leg 122 coupled to the seat back 120 as shown in FIGS. 10-11. The seat back 120 is configured to support an occupant's back when the chair 110 is in the expanded-use mode. A user may also hold the seat back 120 to carry the chair 110 when it is in the collapsed-storage mode. The front leg 122 is integrally coupled to and is configured to move with the seat back 120 upon pivoting movement of the seat bottom 114. In the illustrative embodiment, the seat back 120 is coupled to the rear-leg unit 116.

In the illustrative embodiment, the front leg 122 is coupled to the seat bottom 114 as shown in FIGS. 10-11. The front leg 122 includes a first front-leg segment 124, a second front-leg segment 126 spaced apart from the first front-leg segment 124, and a front spacer 128 coupled to and interconnecting the first front-leg segment 124 and the second front-leg segment 126. The front spacer 128 defines an internal front-leg width 122W that is equal to a width 120W of the seat back 120. In other embodiments, the internal front-leg width 122W may be less than or greater than the seat-back width 120W.

Each front-leg segment 124, 126 has an angled bottom surface 124S, 126S, as shown in FIGS. 10-11. Each angled bottom surface 124S, 126S is configured to lie flat on a floor 11 when the foldable chair 110 is positioned upright relative to the floor 11 and is in the expanded-use mode. When the foldable chair 110 is positioned upright relative to the floor 11 and is in the collapsed-storage mode, a rear end 124R, 126R of each angled surface 124S, 126S is spaced apart from the floor 11 while a front end 124F, 126F of each angled surface 124S, 126S is in contact with the floor 11.

The seat bottom 114 is mounted to the first front-leg segment 124, the second front-leg segment 126, and the rear-leg drivers 118 as shown in FIGS. 10-11 for pivotable movement relative to the seat back 120. The seat bottom 114 is configured to support a user when the foldable seat 110 is in the expanded-use mode. The seat bottom 114 is movable from a horizontal-support position, shown in FIG. 10, in which a support surface 114S of the seat bottom 114 is separated from the seat back 120 by a support angle 130, to a vertical-stowed position, shown in FIG. 11, in which the support surface 114S is separated from the seat back 120 by a stowed angle 132. The support angle 130 is greater than the stowed angle 132. For example, the support angle 130 may be greater than 90 degrees and the stowed angle 132 may be less than 90 degrees.

The seat bottom 114 includes pivot axles 134 coupled to and interconnecting a middle portion of the seat bottom 114 and the first front-leg segment 124, and the seat bottom 114 and the second front-leg segment 126, respectively, such that the seat bottom 114 is positioned between the first front-leg segment 124 and the second front-leg segment 126. Accordingly, the seat bottom 114 has a width 114W that is less than the internal front-leg width 122W. The pivot axles 134 define a first pivot axis 134A about which the seat bottom 114 rotates between the horizontal-supported position and the vertical-stowed position.

As shown in FIG. 18, the pivot axle 134 creates a gap 1340 between the first front-leg segment 124 and the seat bottom 114 at the first pivot axis 134A when the seat bottom 114 is in both the horizontal-support position and the vertical-stowed position. The illustrative embodiment also includes the same configuration for the second front-leg segment 126 and the seat bottom 114. The gaps 1340 between the front-leg segments 124, 126 and the seat bottom 114 is the same between the horizontal-support position and the vertical-stowed position, and is sized to be no less than 0.5 inches. Accordingly, when the seat bottom 114 is moved towards seat back 120 to establish the collapsed-storage mode, a finger which is approximately less than 0.5 inches may not be pinched between the seat bottom 114 and the front-leg unit 112. In the illustrative embodiment, the gaps 134G are defined between a bottom-facing surface 124B, 126B of each front-leg segment and leg-facing surfaces 114L of the seat bottom as shown in FIG. 10

The rear-leg unit 116 include a rear leg 136 and rear-leg offsets 138 coupled to an interconnecting the rear leg 136 and the seat back 120 as shown in FIGS. 10-11. The rear leg 136 is movable between an extended position in which the rear leg 136 is separated from the front leg 122 by an extended angle 140 and a retracted position in which the rear leg 136 is separated from the front leg 122 by a retracted angle 142. The rear-leg offsets 138 are configured to space apart the rear leg 122 and the seat back 120.

In the illustrative embodiment, the rear leg 136 is coupled to the seat back 120 via the rear-leg offset 138 and the seat bottom 114 via the rear-leg drivers 118 as shown in FIGS. 10-11 and 14. The rear leg 136 includes a first rear-leg segment 144, a second rear-leg segment 146 spaced apart from the first rear-leg segment 144, and a rear spacer 148 coupled to and interconnecting the first rear-leg segment 144 and the second rear-leg segment 146. The rear spacer 148 defines an internal rear-leg width 136W that is greater than the seat-bottom width 114W. In some embodiments, the internal rear-leg width 136W may be less than, equal to, or greater than the internal front-leg width 122W.

Each rear-leg segment 144, 146 has an angled bottom surface 144S, 146S, as shown in FIGS. 10-11. Each angled bottom surface 144S, 146S is configured to lie flat on the floor 1I when the foldable chair 110 is positioned upright relative to the floor 11 and is in the expanded-use mode. When the foldable chair 110 is positioned upright relative to the floor 11 and is in the collapsed-storage mode, a forward end 144F, 146F of each angled surface 144S, 146S is spaced apart from the floor 11 while a rear end 144R, 146R of each angled surface 144S, 146S is in contact with the floor 11.

The rear-leg unit 116 further includes pivot axles 150 that each define a second pivot axis 150A about which the rear leg 136 rotates relative to the rear-leg offsets 138, as shown in FIGS. 10-12. In the illustrative embodiment, an upper end 144U, 146U of each rear-leg segment 144, 146 is formed to include an offset aperture 152 adapted to receive an angled segment 154 of each respective rear-leg offset 138. Each pivot axle 150 feeds through the respective angled segment 154 and rear-leg segment 144, 146 so that the rear leg 136 is rotatable about the pivot axis 150A. Furthermore, each front-leg segment 124, 126 is formed to include a planar aperture 158, as shown in FIG. 17, that is adapted to receive a planar segment 156 of each respective rear-leg offset 138. Each planar segment 156 is fixed to the respective front-leg segment 124, 126. As shown in FIG. 12, the angled segment 154 is angled relative to a rear surface 156R of the planar segment 156 such that an angle between a top surface 154T of the angled segment 154 and the rear-surface 156R is greater than 90 degrees and an angle between a bottom surface 154B of the angled segment 154 and the rear surface 156R is less than 90 degrees.

The rear-leg offset 138 is configured to create an upper gap 138G between an upper end of the first rear-leg segment 144 and the seat back 120 at the second pivot axis 150A when the rear-leg unit 116 is in both the extended position and the retracted position. The illustrative embodiment also includes the same configuration for the second rear-leg segment 146 and the seat back 120. The gaps 138G between the seat back 120 and the upper ends 144U, 146U of the rear-leg segments 144, 146 are sized to be no less than approximately 0.5 inches in both the extended position and the retracted position of the rear-leg unit 116. Accordingly, when a user, such as a child, changes the foldable chair 110 from the expanded-use mode to the collapsed-storage mode, and vice versa, pinching of the child's finger between the seat back 120 and the rear-leg unit 116 is minimized. Specifically, when the rear-leg unit 116 is moved towards the front-leg unit 112 to establish the collapsed-storage mode, a finger which is approximately less than 0.5 inches may not be pinched between the seat back 120 and the rear-leg unit 116. In the illustrative embodiment, the gaps 1380 are defined between a rear-facing surface 120R of the seat back 120 and a front-facing surface 144SF, 146SF of each rear-leg segment 144, 146.

The rear-leg driver 118 is configured to provide means for rotating the rear-leg unit 116 about the second pivot axis 150A and away from the front-leg unit 112 in response to pivoting movement of the seat bottom 114 about the first pivot axis 138A away from the seat back 120 to establish the expanded-use mode of the foldable chair 110 as shown in FIGS. 10 and 15. The rear-leg driver 118 is also configured to provide means for rotating the rear-leg unit 116 about the second pivot axis 150A and towards the front-leg unit 112 in response to pivoting movement of the seat bottom 114 about the first pivot axis 138A towards from the seat back 120 to establish the collapsed-storage mode of the foldable chair 110 as shown in FIGS. 11 and 16.

The rear-leg driver 118 includes at one end a pivot mount 160 that is coupled to a rear portion of the seat bottom 114, a slider 162 that is adapted to be placed in a slide passageway 164 formed to extend along a length of each of the rear-leg segments 144, 146, and a connecting rod 166 interconnecting the pivot mount 160 and the slider 162 as shown in FIGS. 12 and 13. The seat bottom 114 includes pivot axles 192 which couple the pivot mount 160 to the seat bottom 114 via a mount aperture 160A formed in the pivot mount 160. The pivot axles 192 define a pivot axis 192A, and the seat bottom 114 rotates about the pivot axis 192A to move the slider 162 along the slide passageway 164 when the foldable chair 110 is moved between the collapsed-storage mode and the expanded-use mode.

The rear-leg driver 118 of the illustrative embodiment is made from two pieces of metal machined together as shown in FIGS. 12 and 13. The slider 162 is planar and defines a plane of the original metallic sheet from which the slider 162 is formed. The connecting rod 166 includes a first planar segment 166A that is coupled to, extends away from and defines a plane that is perpendicular to the plane of the slider 162, and a second planar segment 166B that extends away from and defines a plane that is separated from the plane of the first planar segment 166A by an angle 196 that is greater than 90 degrees. The connecting rod 166 also includes a curved segment 166C that interconnects the first planar segment 166A and the second planar segment 166B. The pivot mount 160 is also planar and defines a plane that is parallel to the plane of the slider 162.

Accordingly, the connecting rod 166 is configured to create various gaps 198A, 198B between the pivot mount 160 and the slider 162 as shown in FIG. 13. The first driver gap 198A is defined between the parallel planes of the pivot mount 160 and the slider 162 and is no less than 0.5 inches so that the seat bottom 114 is spaced apart from the rear-leg unit 116. When the seat bottom 114 is moved towards seat back 120 to establish the collapsed-storage mode, a finger which is approximately less than 0.5 inches may not be pinched between the seat bottom 114 and the rear-leg unit 116. As shown in FIG. 18, the first driver gap 198A defines a rear gap 118R between the seat bottom and each respective rear leg 144, 146. The rear gap 118R cooperates with the gap 134G to separate the leg-facing surface 114L of the seat bottom 114 from the bottom-facing surfaces 124B, 126B of the front-leg unit 112 and the bottom-facing surfaces 144B, 146B of the rear-leg unit 116 no less than 0.5 inches. Accordingly, a finger sized smaller than the gaps 118R, 134G cannot be pinched between the seat bottom 114 and the front and rear-leg units 112, 116 when the foldable chair 110 is moved from the expanded-use mode to the collapsed-storage mode.

The second driver gap 198B is defined between a plane perpendicular to the pivot mount 160 at the mount aperture 160A and the plane of the second planar segment 166B. The second driver gap 198B is no less than 0.5 inches so that the rear-leg segments 144, 146 are spaced apart from the respective front-leg segments 124, 126. When the seat bottom 114 is moved towards the seat back 120 to establish the collapsed-storage mode, a finger which is approximately less than 0.5 inches may not be pinched between the rear-leg segments 144, 146 and the respective front-leg segments 124, 126. As shown in FIG. 16, the second driver gap 198B defines a lower gap 118L between a rear-facing surface 124SR, 126SR of each respective front leg 124, 126 and the front-facing surface 144SF, 146SF of each rear leg 144, 146 when the rear-leg unit 116 is in the retracted position. The lower gap 118G cooperates with the upper gap 138G to separate the front-leg unit 112 from the rear-leg unit 116 no less than 0.5 inches. Accordingly, a finger sized smaller than the gaps 118L, 1380 cannot be pinched between the front and rear-leg units 112, 116 when the foldable chair 110 is moved from the expanded-use mode to the collapsed-storage mode.

To move the foldable chair 110 from the expanded-use mode to the collapsed-storage mode, the seat bottom 114 rotates in a first direction 168 towards the seat back 120 about the first pivot axis 134A to rotate the pivot mount 160 about the third pivot axis 192A and push the slider 162 in a second direction 170 away from the seat back 120 so that the rear leg 136 rotates about the second pivot axis 150A in a third direction 172 towards the front leg 122 as shown in FIGS. 15 and 16.

Turning back to the rear-leg unit 116, each rear-leg segment 144, 146 is formed to include the slide passageway 164 as shown in FIG. 18. In the illustrative embodiment, the slide passageway 164 is positioned between the rear-leg offset 138 and the rear spacer 148. The rear-leg unit 116 further includes cover plates 174 fixed to each rear-leg segment 144, 146 and formed to include a rod passageway 176 configured to receive at least a portion of the connecting rod 166 so that the connecting rod 166 slides in the rod passageway 176 as the foldable chair 110 is moved between the expanded-use mode and the collapsed storage mode. In the illustrative embodiment, the rod passageway 176 is positioned centrally in the cover plate 174. The rod passageway 176 is sized to have a width of less than approximately 0.2 inches to prevent access of a finger being inserted in the rod passageway 176 and being pinched by the rear-leg driver 118.

Each rear-leg segment 144, 146 includes an inner surface 178 facing the seat bottom 114 and an outer surface 180 opposite the inner surface 178 facing away from the seat bottom 114 as shown in FIG. 18. A portion of the inner surface 178 forms an opening 182 and a plate wall 184 is positioned between the inner surface 178 and the outer surface 180 to form a plate-receiving aperture 186. Accordingly, the cover plate 174 is fixed between the inner surface 178 and the plate wall 184. Similarly, a portion of the plate wall 184 forms an opening 188 and a slider wall 190 is positioned between the plate wall 184 and the outer surface 180 to form the slide passageway 164.

In the illustrative embodiment shown in FIG. 18, a length of the slide passageway 164 is defined between an upper end 164A and a lower end 164B of the slide passageway 164. A length of the plate-receiving aperture 186 is defined between an upper end 186A and a lower end 186B of the plate-receiving aperture 182. Finally, a length of the rod passageway 176 is defined between an upper end 176A and a lower end 176B of the rod passageway 176. The plate-receiving aperture 186 length is greater than the slide passageway 164 length such that the upper end 186A is positioned above the upper end 164A and the lower end 186B is positioned below the lower end 164B so that the cover plate 174 can be fixed to the plate wall 180.

The rod passageway 176 length is less than the slide passageway 164 length such that the upper end 176A is positioned below the upper end 164A and the lower end 176B is positioned above the lower end 164B as shown in FIG. 18. The distance between the upper ends 164A, 176A and the distance between the lower ends 164B, 176B is sized such that the connecting rod 166 is spaced apart from the upper end 176A when the foldable chair 110 is in the expanded-use mode and is spaced apart from the lower end 176B when the foldable chair 110 is in the collapsed-storage mode. In both modes, the connecting rod 166 is spaced apart from the respective ends 176A, 176B by less than approximately 0.2 inches so that a finger is prevented from being inserted in the vertical space between the connecting rod 166 and the respective ends 176A, 176B. Additionally, the rod passageway 176 is sized such that the width is less than approximately 0.2 inches so that a finger cannot be pinched between the connecting rod 166 and the upper and lower ends 176A, 176B of the rod passageway 176.

In the illustrative embodiment, the front-leg unit 112, the seat bottom 114, and the rear-leg unit 116 may be made from wood, such as hardwood, softwood, engineered wood, or any type of wood suitable for furniture, including but not limited to, pine, cedar, fir, and spruce. The rear-leg driver 118 and the cover plate 174 may be made from metal, such as steel, titanium, aluminum, or any other metal or alloy suitable for furniture.

Another embodiment of a foldable chair 210 is shown in FIGS. 19-29. The foldable chair 110 is similar to the foldable chairs 10, 110 shown in FIGS. 1-18 and described herein. Accordingly, similar reference numbers in the 200 series indicate features that are common between the foldable chair 210 and the foldable chairs 10, 110. The description of the foldable chairs 10, 110 are incorporated by reference to apply to the foldable chair 210, except in instances when they conflict with the specific description and the drawings of the foldable chair 210. Specifically, each rear-leg segment 244, 246 is formed to include both the slide passageway 264 and the rod passageway 276. The slide passageway 264 is defined between the rod passageway 276 and an opening 283 formed in the outer surface 282. The rear-leg unit 216 further includes a plastic cap 299, shown in FIGS. 19-27, or a metal cap 399, shown in FIGS. 28-29, configured to block access by a finger into the slide passageway 264 through the opening 283. Additionally, the connecting rod 266 includes additional features to create gaps 298A, 298B.

The foldable chair 210 includes a front-leg unit 212 and a seat bottom 214 mounted to the front-leg unit 212 for pivotable movement relative to the front-leg unit 212 during folding and unfolding of the foldable chair 210, as shown in FIGS. 19-20. The foldable chair 210 also includes a rear-leg unit 216 mounted on the front-leg unit 212 for pivotable movement relative to the front-leg unit 212 during folding and unfolding of the foldable chair 210, as shown in FIGS. 19-20. The foldable chair 210 further includes a rear-leg driver 218, shown in FIGS. 19 and 19A, configured to provide means for driving the rear-leg unit 216 away from the front-leg unit 212 in response to pivoting movement of the seat bottom 214 away from the front-leg unit 212 during unfolding of the foldable chair 210. The rear-leg driver 218 also provides means for driving the rear-leg unit 216 towards the front-leg unit 212 in response to pivoting movement of the seat bottom 214 towards the front-leg unit 212 during folding of the foldable chair 210. In the illustrative embodiment, the foldable chair 210 includes two rear-leg drivers 218.

The foldable chair 210 is adjustable between an expanded-use mode, shown in FIG. 19, in which the seat bottom 214 is supported in a substantially horizontal orientation to support an occupant and a collapsed-storage mode, shown in FIG. 20, in which the seat bottom 214 is supported in a substantially vertical orientation.

The front-leg unit 212 includes a seat back 220 and a front leg 222 coupled to the seat back 220 as shown in FIGS. 19-20. The seat back 220 is configured to support an occupant's back when the chair 210 is in the expanded-use mode. A user may also hold the seat back 220 to carry the chair 210 when it is in the collapsed-storage mode. The front leg 222 is integrally coupled to and is configured to move with the seat back 220 upon pivoting movement of the seat bottom 214. In the illustrative embodiment, the seat back 220 is coupled to the rear-leg unit 216.

In the illustrative embodiment, the front leg 222 is coupled to the seat bottom 214 as shown in FIGS. 19-20. The front leg 222 includes a first front-leg segment 224, a second front-leg segment 226 spaced apart from the first front-leg segment 224, and a front spacer 228 coupled to and interconnecting the first front-leg segment 224 and the second front-leg segment 226. The front spacer 228 defines an internal front-leg width 222W that is equal to a width 220W of the seat back 220. In other embodiments, the internal front-leg width 222W may be less than or greater than the seat-back width 220W.

Each front-leg segment 224, 226 has an angled bottom surface 224S, 226S, as shown in FIGS. 19-20. Each angled bottom surface 224S, 226S is configured to lie flat on a floor 11 when the foldable chair 210 is positioned upright relative to the floor 11 and is in the expanded-use mode. When the foldable chair 210 is positioned upright relative to the floor 11 and is in the collapsed-storage mode, a rear end 224R, 226R of each angled surface 224S, 226S is spaced apart from the floor 11 while a front end 224F, 226F of each angled surface 224S, 226S is in contact with the floor 11.

The seat bottom 214 is mounted to the first front-leg segment 224, the second front-leg segment 226, and the rear-leg drivers 218 as shown in FIGS. 19-20 for pivotable movement relative to the seat back 220. The seat bottom 214 is configured to support a user when the foldable seat 210 is in the expanded-use mode. The seat bottom 214 is movable from a horizontal-support position, shown in FIG. 19, in which a support surface 214S of the seat bottom 214 is separated from the seat back 220 by a support angle 230, to a vertical-stowed position, shown in FIG. 20, in which the support surface 214S is separated from the seat back 220 by a stowed angle 232. The support angle 230 is greater than the stowed angle 232. For example, the support angle 230 may be greater than 90 degrees and the stowed angle 232 may be less than 90 degrees.

The seat bottom 214 includes pivot axles 234 coupled to and interconnecting a middle portion of the seat bottom 214 and the first front-leg segment 224, and the seat bottom 214 and the second front-leg segment 226, respectively, such that the seat bottom 214 is positioned between the first front-leg segment 224 and the second front-leg segment 226. Accordingly, the seat bottom 214 has a width 214W that is less than the internal front-leg width 222W. The pivot axles 234 define a first pivot axis 234A about which the seat bottom 214 rotates between the horizontal-supported position and the vertical-stowed position.

As shown in FIG. 27, the pivot axle 234 creates a gap 2340 between the first front-leg segment 224 and the seat bottom 214 at the first pivot axis 234A when the seat bottom 214 is in both the horizontal-support position and the vertical-stowed position. The illustrative embodiment also includes the same configuration for the second front-leg segment 226 and the seat bottom 214. The gaps 2340 between the front-leg segments 224, 226 and the seat bottom 214 is the same between the horizontal-support position and the vertical-stowed position, and is sized to be no less than 0.5 inches. Accordingly, when the seat bottom 214 is moved towards seat back 220 to establish the collapsed-storage mode, a finger which is approximately less than 0.5 inches may not be pinched between the seat bottom 214 and the front-leg unit 212. In the illustrative embodiment, the gaps 234G are defined between a bottom-facing surface 224B, 226B of each front-leg segment and leg-facing surfaces 214L of the seat bottom as shown in FIG. 19.

The rear-leg unit 216 include a rear leg 236 and rear-leg offsets 238 coupled to an interconnecting the rear leg 236 and the seat back 220 as shown in FIGS. 19-20. The rear leg 236 is movable between an extended position in which the rear leg 236 is separated from the front leg 222 by an extended angle 240 and a retracted position in which the rear leg 236 is separated from the front leg 222 by a retracted angle 242. The rear-leg offsets 238 are configured to space apart the rear leg 222 and the seat back 220.

In the illustrative embodiment, the rear leg 236 is coupled to the seat back 220 via the rear-leg offset 238 and the seat bottom 214 via the rear-leg drivers 218 as shown in FIGS. 19-20 and 23. The rear leg 236 includes a first rear-leg segment 244, a second rear-leg segment 246 spaced apart from the first rear-leg segment 244, and a rear spacer 248 coupled to and interconnecting the first rear-leg segment 244 and the second rear-leg segment 246. The rear spacer 248 defines an internal rear-leg width 236W that is greater than the seat-bottom width 214W. In some embodiments, the internal rear-leg width 236W may be less than, equal to, or greater than the internal front-leg width 222W.

Each rear-leg segment 244, 246 has an angled bottom surface 244S, 246S, as shown in FIGS. 19-20. Each angled bottom surface 244S, 246S is configured to lie flat on the floor 1I when the foldable chair 210 is positioned upright relative to the floor 11 and is in the expanded-use mode. When the foldable chair 210 is positioned upright relative to the floor 11 and is in the collapsed-storage mode, a forward end 244F, 246F of each angled surface 244S, 246S is spaced apart from the floor 11 while a rear end 244R, 246R of each angled surface 244S, 246S is in contact with the floor 11.

The rear-leg unit 216 further includes pivot axles 250 that each define a second pivot axis 250A about which the rear leg 236 rotates relative to the rear-leg offsets 238, as shown in FIGS. 19-21. In the illustrative embodiment, an upper end 244U, 246U of each rear-leg segment 244, 246 is formed to include an offset aperture 252 adapted to receive an angled segment 254 of each respective rear-leg offset 238. Each pivot axle 250 feeds through the respective angled segment 254 and rear-leg segment 244, 246 so that the rear leg 236 is rotatable about the pivot axis 250A. Furthermore, each front-leg segment 224, 226 is formed to include a planar aperture 258, as shown in FIG. 26, that is adapted to receive a planar segment 256 of each respective rear-leg offset 238. Each planar segment 256 is fixed to the respective front-leg segment 224, 226. As shown in FIG. 21, the angled segment 254 is angled relative to a rear surface 256R of the planar segment 256 such that an angle between a top surface 254T of the angled segment 254 and the rear-surface 256R is greater than 90 degrees and an angle between a bottom surface 254B of the angled segment 254 and the rear surface 256R is less than 90 degrees.

The rear-leg offset 238 is configured to create an upper gap 238G between an upper end of the first rear-leg segment 244 and the seat back 220 at the second pivot axis 250A when the rear-leg unit 216 is in both the extended position and the retracted position. The illustrative embodiment also includes the same configuration for the second rear-leg segment 246 and the seat back 220. The gaps 238G between the seat back 220 and the upper ends 244U, 246U of the rear-leg segments 244, 246 are sized to be no less than approximately 0.5 inches in both the extended position and the retracted position of the rear-leg unit 216. Accordingly, when a user, such as a child, changes the foldable chair 210 from the expanded-use mode to the collapsed-storage mode, and vice versa, pinching of the child's finger between the seat back 220 and the rear-leg unit 216 is minimized. Specifically, when the rear-leg unit 216 is moved towards the front-leg unit 212 to establish the collapsed-storage mode, a finger which is approximately less than 0.5 inches may not be pinched between the seat back 220 and the rear-leg unit 216. In the illustrative embodiment, the gaps 2380 are defined between a rear-facing surface 220R of the seat back 220 and a front-facing surface 244SF, 246SF of each rear-leg segment 244, 246.

The rear-leg driver 218 is configured to provide means for rotating the rear-leg unit 216 about the second pivot axis 250A and away from the front-leg unit 212 in response to pivoting movement of the seat bottom 214 about the first pivot axis 238A away from the seat back 220 to establish the expanded-use mode of the foldable chair 210 as shown in FIGS. 19 and 24. The rear-leg driver 218 is also configured to provide means for rotating the rear-leg unit 216 about the second pivot axis 250A and towards the front-leg unit 212 in response to pivoting movement of the seat bottom 214 about the first pivot axis 238A towards from the seat back 220 to establish the collapsed-storage mode of the foldable chair 210 as shown in FIGS. 20 and 25.

The rear-leg driver 218 includes at one end a pivot mount 260 that is coupled to a rear portion of the seat bottom 214, a slider 262 that is adapted to be placed in a slide passageway 264 formed to extend along a length of each of the rear-leg segments 244, 246, and a connecting rod 266 interconnecting the pivot mount 260 and the slider 262 as shown in FIGS. 21 and 22. The seat bottom 214 includes pivot axles 292 which couple the pivot mount 260 to the seat bottom 214 via a mount aperture 260A formed in the pivot mount 260. The pivot axles 292 define a pivot axis 292A, and the seat bottom 214 rotates about the pivot axis 292A to move the slider 262 along the slide passageway 264 when the foldable chair 210 is moved between the collapsed-storage mode and the expanded-use mode.

The rear-leg driver 218 of the illustrative embodiment is made from two pieces of metal machined together as shown in FIGS. 21 and 22. The slider 262 is planar and defines a plane of the original metallic sheet from which the slider 262 is formed. The connecting rod 266 includes a first planar segment 266A that is coupled to, extends away from and defines a plane that is perpendicular to the plane of the slider 262, a second planar segment 266B that extends away from and defines a plane that is parallel to the plane of the slider 262, and a third planar segment 266C that extends away from and defines a plane that separated from the plane of the second planar segment 266B by an angle 296 that is greater than 90 degrees. The connecting rod 266 also includes a first curved segment 266D that interconnects the first planar segment 266A and the second planar segment 266B, and the second curved segment 266E that interconnects the second planar segment 266B and the third planar segment 266C. The pivot mount 260 is also planar and defines a plane that is parallel to the plane of the slider 262. As such, the second planar segment 266B is parallel to the planes of both the slider 262 and the pivot mount 260, and is positioned therebetween.

Accordingly, the connecting rod 266 is configured to create various gaps 298A, 298B between the pivot mount 260 and the slider 262 as shown in FIG. 22. The first driver gap 298A is defined between the parallel planes of the pivot mount 260 and the slider 262 and is no less than 0.5 inches so that the seat bottom 214 is spaced apart from the rear-leg unit 216. When the seat bottom 214 is moved towards seat back 220 to establish the collapsed-storage mode, a finger which is approximately less than 0.5 inches may not be pinched between the seat bottom 214 and the rear-leg unit 216. As shown in FIG. 27, the first driver gap 298A defines a rear gap 218R between the seat bottom and each respective rear leg 244, 246. The rear gap 218R cooperates with the gap 234G to separate the leg-facing surface 214L of the seat bottom 214 from the bottom-facing surfaces 224B, 226B of the front-leg unit 212 and the bottom-facing surfaces 244B, 246B of the rear-leg unit 216 no less than 0.5 inches. Accordingly, a finger sized smaller than the gaps 218R, 234G cannot be pinched between the seat bottom 214 and the front and rear-leg units 212, 216 when the foldable chair 210 is moved from the expanded-use mode to the collapsed-storage mode.

The second driver gap 298B is defined between a plane perpendicular to the pivot mount 260 at the mount aperture 260A and the plane of the second planar segment 266B. The second driver gap 298B is no less than 0.5 inches so that the rear-leg segments 244, 246 are spaced apart from the respective front-leg segments 224, 226. When the seat bottom 214 is moved towards the seat back 220 to establish the collapsed-storage mode, a finger which is approximately less than 0.5 inches may not be pinched between the rear-leg segments 244, 246 and the respective front-leg segments 224, 226. As shown in FIG. 25, the second driver gap 298B defines a lower gap 218L between a rear-facing surface 224SR, 226SR of each respective front leg 224, 226 and the front-facing surface 244SF, 246SF of each rear leg 244, 246 when the rear-leg unit 216 is in the retracted position. The lower gap 218G cooperates with the upper gap 238G to separate the front-leg unit 212 from the rear-leg unit 216 no less than 0.5 inches. Accordingly, a finger sized smaller than the gaps 218L, 238G cannot be pinched between the front and rear-leg units 212, 216 when the foldable chair 210 is moved from the expanded-use mode to the collapsed-storage mode.

To move the foldable chair 210 from the expanded-use mode to the collapsed-storage mode, the seat bottom 214 rotates in a first direction 268 towards the seat back 220 about the first pivot axis 234A to rotate the pivot mount 260 about the third pivot axis 292A and push the slider 262 in a second direction 270 away from the seat back 220 so that the rear leg 236 rotates about the second pivot axis 250A in a third direction 272 towards the front leg 222 as shown in FIGS. 24 and 25.

Turning back to the rear-leg unit 216, each rear-leg segment 244, 246 is formed to include the slide passageway 264 and a rod passageway 276 as shown in FIG. 27. In the illustrative embodiment, the slide passageway 264 is positioned between the rear-leg offset 238 and the rear spacer 248. The rod passageway 276 configured to receive at least a portion of the connecting rod 266 so that the connecting rod 266 slides in the rod passageway 276 as the foldable chair 210 is moved between the expanded-use mode and the collapsed storage mode. The rod passageway 276 is sized to have a width of less than approximately 0.2 inches to prevent access of a finger being inserted in the rod passageway 276 and being pinched by the rear-leg driver 218.

Each rear-leg segment 244, 246 includes an inner surface 278 facing the seat bottom 214 and an outer surface 280 opposite the inner surface 278 facing away from the seat bottom 214 as shown in FIG. 27. A portion of the inner surface 278 forms an opening 282 and a portion of the outer surface 280 forms an opening 283. A rod wall 285 is positioned between the inner surface 278 and the outer surface 280 to form the rod passageway 276.

In the illustrative embodiment shown in FIG. 27, a length of the slide passageway 264 is defined between an upper end 264A and a lower end 264B of the slide passageway 264. A length of the rod passageway 276 is defined between an upper end 276A and a lower end 276B of the rod passageway 276. The rod passageway 276 length is less than the slide passageway 264 length such that the upper end 276A is positioned below the upper end 264A and the lower end 276B is positioned above the lower end 264B as shown in FIG. 27. In both modes, the connecting rod 266 is spaced apart from the respective ends 276A, 276B by less than approximately 0.2 inches so that a finger is prevented from being inserted in the vertical space between the connecting rod 266 and the respective ends 276A, 276B. Additionally, the rod passageway 276 is sized such that the width is less than approximately 0.2 inches so that a finger cannot be pinched between the connecting rod 166 and the upper and lower ends 276A. 276B of the rod passageway 276.

The rear-leg unit 216 shown in FIGS. 20 and 27 further includes a cap 299 for each rear-leg segment 244, 246 adapted to cover the opening 283 formed by the outer surface 280 to prevent access by a finger to the slide passageway 264. In the illustrative embodiment, the cap 299 is made of plastic and partially extends away from the outer surface 280 towards the slider 262 and away from the slider 262. The cap 299 includes an inner segment 295 that is sized to fit inside the slide passageway 264 between the slider 262 and the outer surface 280 and an outer segment 297 that is in confronting relation with the outer surface 280. The outer segment 297 has an upper end 299A that is positioned above the upper end 264A of the slide passageway 264 and a lower end 299B that is positioned below the lower end 264B of the slide passageway 264. Thus, the cap 299 blocks the slide passageway 264 to block access of a finger into the slide passageway 264 from the outer surface 280.

In the illustrative embodiment, the front-leg unit 212, the seat bottom 214, and the rear-leg unit 216 may be made from wood, such as hardwood, softwood, engineered wood, or any type of wood suitable for furniture, including but not limited to, pine, cedar, fir, and spruce. The rear-leg driver 218 may be made from metal, such as steel, titanium, aluminum, or any other metal or alloy suitable for furniture.

Alternatively, the foldable chair 210 may have a metal cap 399 as shown in FIGS. 28-29. In such embodiments, an outer surface 399S of each metal cap 399 may be flush with the outer surface 280 of each rear-leg segment 244, 246.

The invention claimed is:

1. A foldable chair comprising a front-leg unit including a seat back and a front leg coupled to the seat back to move therewith during folding and unfolding of the foldable chair, a seat bottom mounted on the front-leg unit for pivotable movement relative to the seat back from a horizontal-support position in which a support surface of the seat bottom is separated from the seat back by a support angle to a vertical-stowed position in which the support surface of the seat bottom is separated from the seat back by a stowed angle, wherein the stowed angle is less than the support angle, a rear-leg unit in spaced apart relation to the front-leg unit so that an upper gap is formed between the seat back and the rear-leg unit and a lower gap is formed between the front leg and the rear-leg unit, and is further mounted on the front-leg unit for pivotable movement relative to the front-leg unit during folding and unfolding of the foldable chair from an extended position in which the rear-leg unit cooperates with the front leg to define an extended angle to a retracted positon in which the rear-leg unit cooperates with the front leg to define a retracted angle, wherein the retracted angle is less than the extended angle, and mover means for driving the rear-leg unit away from the front-leg unit from the retracted position to the extended position in response to pivoting movement of the seat bottom away from the seat back from the vertical-stowed position to the horizontal-support position to establish an expanded-use mode of the foldable chair in which the seat bottom is supported in a substantially horizontal orientation to support an occupant and for driving the rear-leg unit toward the front-leg unit from the extended position to the retracted position in response to pivoting movement of the seat bottom toward the seat back from the horizontal-support portion to the vertical-stowed position to establish a collapsed-storage mode of the foldable chair in which the seat bottom is supported in a substantially vertical orientation while the upper gap between the rear-leg unit and the seat back is maintained in both the expanded-use mode and the collapsed-storage mode, wherein the rear-leg unit comprises a rear leg having a first rear-leg segment and a second rear-leg segment spaced apart from the first-rear-leg segment, wherein the seat bottom is positioned between the first rear-leg segment and the second rear-leg segment, and wherein the mover means comprises a rear-leg driver that includes a pivot mount coupled to a rear end of the seat bottom, a slider adapted to slide along a length of one of the rear-leg segments, and a connecting rod interconnecting the pivot mount and the slider.

2. The foldable chair of claim 1, wherein at least one of rear-leg segments of the rear-leg unit is formed to include the slide passageway configured to receive the slider of the rear-leg driver so that the slider slides in the slide passageway as the foldable chair is adjusted between the expanded-use mode and the collapsed-storage mode.

3. The foldable chair of claim 2, wherein the rear-leg unit further includes a cover plate fixed to one of the rear-leg segments and formed to include a rod passageway configured to receive at least a portion of the connecting rod so that the connecting rod slides in the rod passageway simultaneously with the slider in the slide passageway as the foldable chair is adjusted between the expanded-use mode and the collapsed-storage mode.

4. The foldable chair of claim 3, wherein a length of the slide passageway is defined vertically between an upper end and a lower end of the slide passageway, a length of the rod passageway is defined vertically between an upper end and a lower end of the rod passageway, and wherein the length of the slide passageway is greater than a length of the rod passageway such that both the upper end and the lower end of the slide passageway are spaced vertically outward from the upper end and the lower end of the rod passageway, respectively.

5. The foldable chair of claim 2, wherein the at least one of the two rear-leg segments includes an inner surface facing the seat bottom and an outer surface opposite the inner surface facing away from the seat bottom, and wherein at least a portion of the inner surface forms an opening of the slide passageway and a slider wall of the slide passageway is positioned between the inner surface and the outer surface.

6. The foldable chair of claim 2, wherein the at least one of the two rear-leg segments is formed to include a rod passageway configured to receive at least a portion of the connecting rod so that the connecting rod slides in the rod passageway simultaneously with the slider in the slide passageway as the foldable chair is adjusted between the expanded-use mode and the collapsed-storage mode.

7. The foldable chair of claim 6, wherein a length of the slide passageway is established vertically between an upper end and a lower end of the slide passageway, a length of the rod passageway is established an upper end and a lower end of the rod passageway, and wherein the length of the slide passageway is greater than a length of the rod passageway such that both the upper end and the lower end of the slide passageway are spaced vertically outward from the upper end and the lower end of the rod passageway, respectively.

8. The foldable chair of claim 2, wherein the at least one of the two rear-leg segments includes an inner surface facing the seat bottom and an outer surface opposite the inner surface facing away from the seat bottom, and wherein at least a portion of the inner surface forms an opening of the rod passageway, at least a portion of the outer surface forms an opening of the slide passageway, and a slider wall of the slide passageway is positioned between the inner surface and the outer surface so that the slider wall is positioned between the slider and the pivot mount of the rear-leg driver.

9. A foldable chair comprising a front-leg unit including a seat back and a front leg coupled to the seat back to move therewith during folding and unfolding of the foldable chair, a seat bottom mounted on the front-leg unit for pivotable movement relative to the seat back, a rear-leg unit mounted on the front-leg unit for pivotable movement relative to the front-leg unit during folding and unfolding of the foldable chair, the rear-leg unit including a rear leg and a rear-leg offset interconnecting the seat back and the rear leg so that an upper end of the rear leg is in spaced apart relation to the seat back, wherein an upper gap that is formed between the seat back and the rear leg and a lower gap is formed between the front leg and the rear leg, and a rear-leg driver configured to drive the rear-leg unit away from the seat back in response to pivoting movement of the seat bottom away from the seat back to establish an expanded-use mode of the foldable chair in which the seat bottom is supported in a substantially horizontal orientation to seat an occupant and to drive the rear-leg unit toward the seat back in response to pivoting movement of the seat bottom toward the seat back to establish a collapsed-storage mode of the foldable chair in which the seat bottom is supported in a substantially vertical orientation while the upper gap between the rear leg and the seat back is maintained in both the expanded-use mode and the collapsed-storage mode, wherein the rear-leg driver includes a pivot mount coupled to a rear end of the seat bottom, a slider adapted to be slide along a length of the rear leg, and a connecting rod interconnecting the pivot mount and the slider.

10. The foldable chair of claim 9, wherein the seat bottom includes a pivot axle configured to mount a surface of the seat bottom facing the front leg to a surface of the front leg facing the seat-bottom surface, the pivot axle defines a pivot axis about which the seat bottom rotates relative to the front leg, and the pivot axle spaces the seat-bottom surface apart from the front-leg surface by a front gap so that a finger sized smaller than the front gap cannot be pinched between the seat-bottom surface and the front-leg surface.

11. The foldable chair of claim 10, wherein the slider defines a first plane, the pivot mount defines a second plane that is spaced apart from and parallel to the first plane, and wherein the connecting rod defines a driver gap between the first plane and the second plane that defines a rear gap between the rear leg and the seat-bottom surface, and wherein the rear gap cooperates with the front gap gap to space the seat-bottom surface space apart from the rear leg so that a finger sized smaller than the front gap and the rear gap cannot be pinched between the seat-bottom surface and the rear leg as the foldable chair is adjusted between the expanded-use mode and the collapsed-storage mode.

12. The foldable chair of claim 9, the upper gap is defined between a seat back surface facing the rear leg and a rear leg surface facing the seat back so that a finger sized smaller than the upper gap cannot be pinched between the seat-back surface and the rear-leg surface when the foldable chair is moved from the expanded-use mode to the collapsed-storage mode.

13. The foldable chair of claim 12, wherein the slider defines a first plane, the pivot mount defines a second plane that is spaced apart from and parallel to the first plane, and the connecting rod defines a third plane and fourth plane that is spaced apart from and parallel to the third plane, the third plane and the fourth plane both being perpendicular to the first plane and the second plane, wherein the space between the third plane and the fourth plane defines a driver gap that defines the lower gap, and wherein the lower gap cooperates with the upper gap to space the rear-leg surface from the front leg so that a finger sized smaller than the upper gap and the lower gap cannot be pinched between the front leg and the rear-leg surface when the foldable chair is moved from the expanded-use mode and the collapsed-storage mode.

14. The foldable chair of claim 9, wherein the rear leg includes a first rear-leg segment and a second rear-leg segment spaced apart from the first-rear-leg segment, wherein the seat bottom is positioned between the first rear-leg segment and the second rear-leg segment.

15. The foldable chair of claim 14, wherein at least one of rear-leg segments of the rear-leg unit is formed to include a slide passageway configured to receive the slider of the rear-leg driver so that the slider slides in the slide passageway as the foldable chair is adjusted between the expanded-use mode and the collapsed-storage mode.

16. The foldable chair of claim 15, wherein the rear leg further includes a rear spacer interconnecting the first rear-leg segment and the second rear-leg segment.

17. The foldable chair of claim 16, wherein the slide passageway is located between the rear-leg offset and the rear spacer.

* * * * *